US009535371B2

(12) United States Patent
Kitagawa et al.

(10) Patent No.: US 9,535,371 B2
(45) Date of Patent: Jan. 3, 2017

(54) TONER CONTAINER, IMAGE FORMING APPARATUS TO WHICH TONER CONTAINER IS ATTACHED

(71) Applicant: KYOCERA Document Solutions Inc., Osaka-shi, Osaka (JP)

(72) Inventors: Hiroaki Kitagawa, Osaka (JP); Takashi Morita, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/616,989

(22) Filed: Feb. 9, 2015

(65) Prior Publication Data

US 2016/0179033 A1 Jun. 23, 2016

(30) Foreign Application Priority Data

Dec. 19, 2014 (JP) ..... 2014-257575

(51) Int. Cl.
*G03G 15/08* (2006.01)

(52) U.S. Cl.
CPC ..... *G03G 15/0891* (2013.01)

(58) Field of Classification Search
CPC ..... G03G 2215/0827; G03G 15/0891; G03G 15/0889
USPC ..... 399/263
See application file for complete search history.

(56) References Cited

U.S. PATENT DOCUMENTS

2011/0229213 A1* 9/2011 Mihara ..... G03G 15/0875 399/263
2013/0259532 A1* 10/2013 Kubota ..... G03G 21/1676 399/254

FOREIGN PATENT DOCUMENTS

JP 2009080477 A 4/2009

* cited by examiner

*Primary Examiner* — Walter L Lindsay, Jr.
*Assistant Examiner* — Ruth Labombard
(74) *Attorney, Agent, or Firm* — Alleman Hall McCoy Russell & Tuttle LLP

(57) ABSTRACT

A toner container includes a container main body, a cylindrical portion, an opening/closing member, and a conveyance member. Container main body includes a storing chamber. Opening/closing member is provided in a inner space of cylindrical portion and, operates to open and close a toner discharge outlet of cylindrical portion. Conveyance member includes rotation shaft and blades along rotation shaft and when rotated, allows blades to convey the toner that is present inside storing chamber and the inner space toward toner discharge outlet. The plurality of blades include a first blade and a second blade. First blade is disposed in storing chamber at a position near a boundary between storing chamber and the inner space and is larger in outer diameter than the other blades. Second blade is disposed in the inner space and is larger than first blade in inclination angle with respect to rotation shaft of conveyance member.

8 Claims, 29 Drawing Sheets

TONER CONTAINER, IMAGE FORMING APPARATUS TO WHICH TONER CONTAINER IS ATTACHED

INCORPORATION BY REFERENCE

This application is based upon and claims the benefit of priority from the corresponding Japanese Patent Application No. 2014-257575 filed on Dec. 19, 2014, the entire contents of which are incorporated herein by reference.

BACKGROUND

The present disclosure relates to a toner container including a conveyance member that conveys toner stored in the toner container to a toner discharge outlet, and to an image forming apparatus to which the toner container is attached.

A developing device is installed in an image forming apparatus which is a copier, a printer or the like that forms an image on a print sheet based on the electrophotography. As developing is performed by the developing device, toner inside the developing device is reduced. As a result, the image forming apparatus is configured such that a toner container storing toner can be attached and detached to/from the image forming apparatus. The toner is supplied to the developing device from a toner storing chamber of the toner container. Specifically, the toner container includes a toner discharge outlet and an opening/closing member, wherein the toner is discharged outside from the toner discharge outlet, and the opening/closing member opens and closes the toner discharge outlet. When an operation lever is operated, the opening/closing member is dislocated from a closing position to an opening position, wherein the operation lever is provided on the toner container or the device main body. This allows the toner discharge outlet to be opened, and the toner in the toner storing chamber is discharged outside.

Inside of this type of toner container, a conveyance member is provided to convey toner stored in the toner storing chamber to the toner discharge outlet. Furthermore, in the conveyance member, a plurality of blades are provided on a rotation shaft along an axis direction.

SUMMARY

A toner container according to an aspect of the present disclosure includes a container main body, a cylindrical portion, an opening/closing member, and a conveyance member. The container main body includes a storing chamber in which toner is stored. The cylindrical portion extends outside from a side wall of the container main body and has an inner space that communicates with the storing chamber. A toner discharge outlet is formed on the circumferential surface of the cylindrical portion. The opening/closing member is provided in the inner space of the cylindrical portion and, upon receiving a driving force, operates to open and close the toner discharge outlet. The conveyance member is rotatably provided in a region extending from the storing chamber to the inner space, includes a rotation shaft and a plurality of blades along the rotation shaft and when rotated, allows the plurality of blades to convey the toner that is present inside the storing chamber and the inner space toward the toner discharge outlet. The plurality of blades include a first blade and a second blade. The first blade is disposed in the storing chamber at a position near a boundary between the storing chamber and the inner space and is larger in outer diameter than the other blades. The second blade is disposed in the inner space and is larger than the first blade in inclination angle with respect to the rotation shaft of the conveyance member.

An image forming apparatus according to another aspect of the present disclosure includes the toner container, and forms an image on a recording medium by using toner supplied from the toner container.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
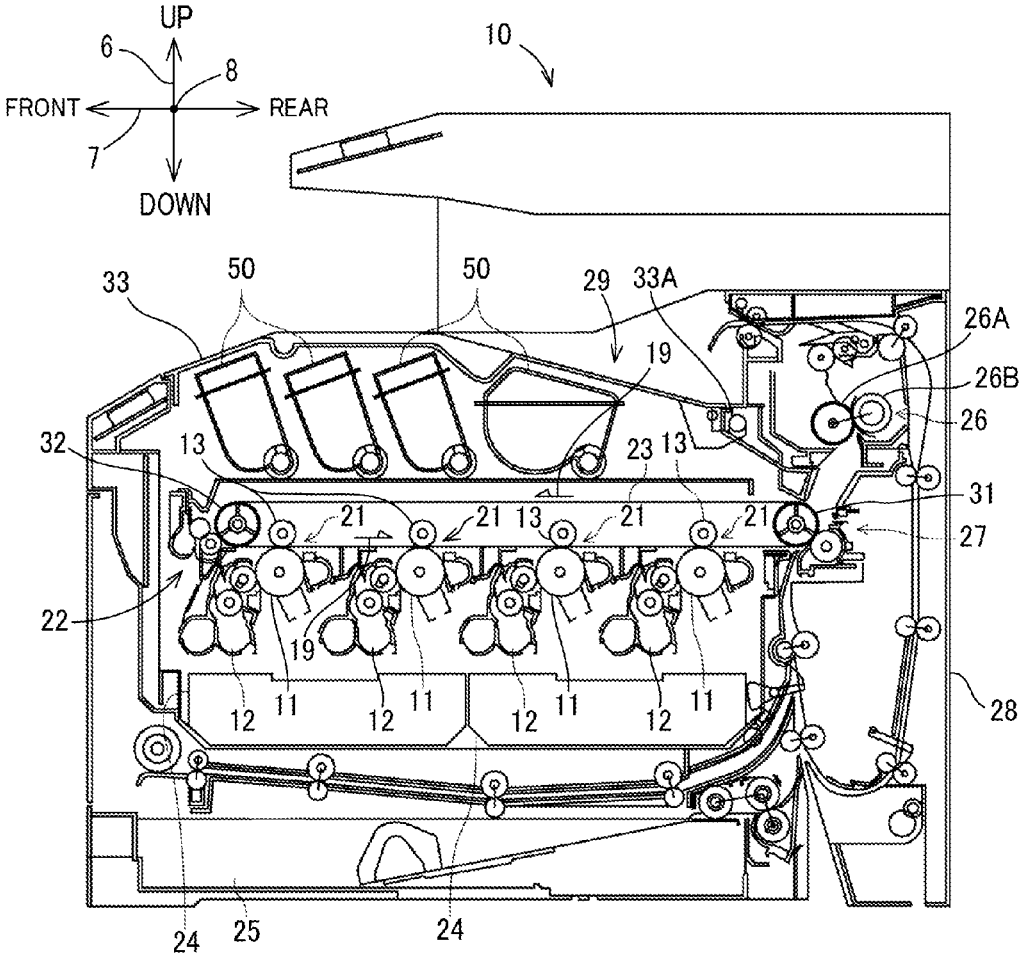
FIG. 1 is a diagram showing the configuration of an image forming apparatus according to an embodiment of the present disclosure.

The following describes an embodiment of the present disclosure with reference to the drawings. It should be noted that the following description is an example of a specific embodiment of the present disclosure and should not limit the technical scope of the present disclosure. It is noted that for the sake of explanation, an up-down direction 6 is defined based on the state (the state shown in FIG. 1) where an image forming apparatus 10 in an embodiment of the present disclosure is installed on a flat surface. In addition, a front-rear direction 7 is defined on the supposition that the left side on the paper surface of FIG. 1 is the front side (front-surface side) of the image forming apparatus 10. Furthermore, a left-right direction 8 (a direction perpendicular to the paper surface of FIG. 1) is defined based on the image forming apparatus 10 shown in FIG. 1. That is, the front side on the paper surface of FIG. 1 is the right side of the image forming apparatus 10, and the depth side on the paper surface of FIG. 1 is the left side of the image forming apparatus 10.

[Image Forming Apparatus 10]

The image forming apparatus 10 is an apparatus that includes at least a print function. As shown in FIG. 1, the image forming apparatus 10 is a so-called tandem color printer. The image forming apparatus 10 prints an image on a sheet of print paper (recording medium) by using a developer that contains toner. It is noted that the image forming apparatus 10 may be any apparatus as far as it has the print function. For example, the image forming apparatus 10 may be a multifunction peripheral having a plurality of functions including the print function, or an image forming apparatus such as a FAX apparatus or a copier. Of course, the image forming apparatus 10 may be an apparatus that forms a monochrome image, instead of an apparatus that forms a color image.

As shown in FIG. 1, the image forming apparatus 1 includes, as major components, four image forming portions 21, an intermediate transfer unit 22, a sheet feed device 25, a fixing device 26, a secondary transfer device 27, an exposure device 24, and four toner containers 50 (50A-50D). These components are attached to an apparatus main body 28 of the image forming apparatus 10. The apparatus main body 28 is a housing that forms an external frame (not shown) and an internal frame (not shown) of the image forming apparatus 10. It is noted that the toner containers 50 are an example of the toner container in the image forming apparatus 10.

The four image forming portions 21 are disposed, in the apparatus main body 28, below the intermediate transfer unit 22. The image forming portions 21 are aligned along the front-rear direction 7. Each image forming portion 21 executes an image forming process of forming an image on a print sheet based on the so-called electrophotography. Specifically, each image forming portion 21 forms an image on a print sheet based on image data input from outside via a network communication portion (not shown). Each image forming portion 21 includes a photoconductor drum 11, a charging device (not shown), a developing device 12, a primary transfer device 13, and the like. The image forming portions 21 form toner images respectively on the photoconductor drums 11, and transfer the toner images to a transfer belt 23 provided in the intermediate transfer unit 22 by overlaying the respective toner images on the transfer belt 23 in sequence. In an example shown in FIG. 1, in order from the downstream side in the movement direction of the transfer belt 23 (the direction indicated by the arrow 19), the image forming portions 21 for black, cyan, magenta, and yellow are disposed in a row in the apparatus main body 28.

The intermediate transfer unit 22 is disposed above the image forming portions 21. A driving pulley 31 and a driven pulley 32 are provided at opposite ends of the intermediate transfer unit 22 in the front-rear direction 7. The transfer belt 23 is suspended between and supported by the driving pulley 31 and the driven pulley 32. This allows a belt surface to extend horizontally in the front-rear direction 7. In addition, with the configuration where the transfer belt 23 is supported by the driving pulley 31 and the driven pulley 32, the transfer belt 23 can move in the direction indicated by the arrow 19 while its surface is contacting the surfaces of the photoconductor drums 11. The transfer belt 23 is a belt having a shape of an endless loop and is made of rubber, urethane or other material.

The secondary transfer device 27 transfers, to a print sheet, the toner images of a plurality of colors transferred to the transfer belt 23. The print sheet with toner images transferred thereto is conveyed to the fixing device 26. The fixing device 26 fixes the toner images transferred to the print sheet, to the print sheet by heat. The fixing device 26 includes a heating roller 26A and a pressure roller 26B. The heating roller 26A is heated to a high temperature. The pressure roller 26B is arranged to face the heating roller 26A. The print sheet conveyed to the fixing device 26 is conveyed while being nipped at a nip portion between the heating roller 26A and the pressure roller 26B by a predetermined biasing force. This allows the toner images to be fused and adhered to the print sheet. Subsequently, the print sheet is discharged onto a discharge tray 29 provided on an upper part of the apparatus main body 28.

It is noted that the image forming apparatus 10 may have a configuration where the transfer belt 23 is used as a conveyance belt, and the toner images are overlaid directly on a print sheet while the paper sheet is conveyed by the conveyance belt. In addition, the image forming apparatus 10 may have a configuration where an intermediate transfer member shaped like a roller is used instead of the transfer belt 23.

The four toner containers 50 (50A-50D) are disposed above the intermediate transfer unit 22. The four toner containers 50 are provided, in the apparatus main body 28, in a row along the transfer belt 23 in the front-rear direction 7. The toner containers 50 are configured to supply toner to developing devices 12 of corresponding colors.

Figure 2A:
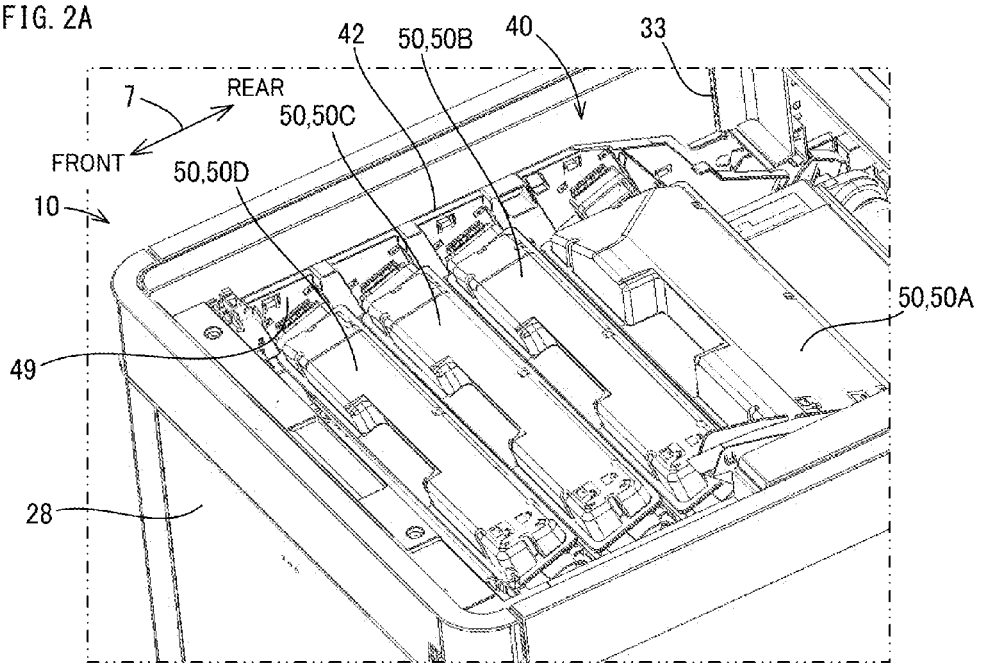
FIG. 2A is a diagram showing the state where toner containers are attached to the image forming apparatus.
Figure 2B:
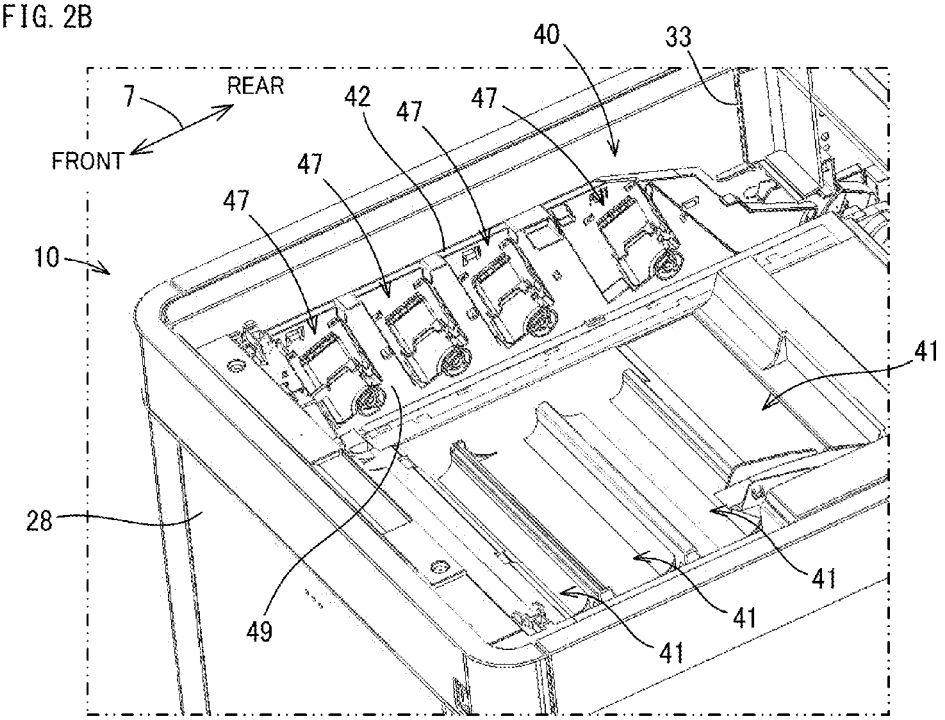
FIG. 2B is a diagram showing an attachment portion of the image forming apparatus to which the toner containers are attached.

As shown in FIGS. 2A and 2B, an attachment portion 40 to which the toner containers 50 are attached is provided inside the apparatus main body 28. Specifically, the attachment portion 40 is provided above the intermediate transfer unit 22. A top cover 33 provided on an upper part of the apparatus main body 28 is supported by a spindle 33A (see FIG. 1) of the apparatus main body 28 such that the top cover 33 can be opened and closed pivotally around the spindle 33A of the apparatus main body 28. When the top cover 33 is rotationally moved upward (in the opening direction), the attachment portion 40 is exposed. The attachment portion 40 is a portion to which the toner containers 50 are attached. The attachment portion 40 is formed on the intermediate transfer unit 22 integrally therewith. When attached to the attachment portion 40, the toner containers 50 are held in four housing spaces 41 formed in the attachment portion 40. It is noted that the attachment portion 40 may not necessarily be formed on the intermediate transfer unit 22 integrally therewith, but may be attached to the apparatus main body 28 as an independent member separate from the intermediate transfer unit 22.

The toner containers 50 store toner of different colors in correspondence with the colors of the image forming portions 21. Specifically, the toner containers 50 (50A-50D) respectively store toner of black, cyan, magenta, and yellow. As shown in FIGS. 1 through 2B, among the four toner containers 50, the toner container 50A positioned on the most rear side is a large-capacity type and can store larger amount of toner than the other toner containers 50B-50D. The toner container 50A stores black toner. The toner containers 50B-50D have the same shape and capacity. The toner container 50B stores cyan toner, the toner container 50C stores magenta toner, and the toner container 50D stores yellow toner.

[Configuration of Toner Containers 50]

The following describes the configuration of the toner containers 50. It is noted here that the large-capacity-type toner container 50A and the other toner containers 50B-50D have the same configuration except for the size of the toner storing part. In addition, the toner containers 50B-50D have the same configuration except for the arrangement position. As a result, in the following description, the toner containers 50A-50D are described as a toner container 50.

The toner container 50 has a function to supply toner to the developing device 12. The toner container 50 stores, inside thereof, toner that is to be supplied to the developing device 12. The toner container 50 is supported such that it can be attached and detached to/from the attachment portion 40 (see FIG. 2). The toner container 50 is inserted from an upper opening of the apparatus main body 28 and held in the housing space 41 in the attachment portion 40.

Figure 5:
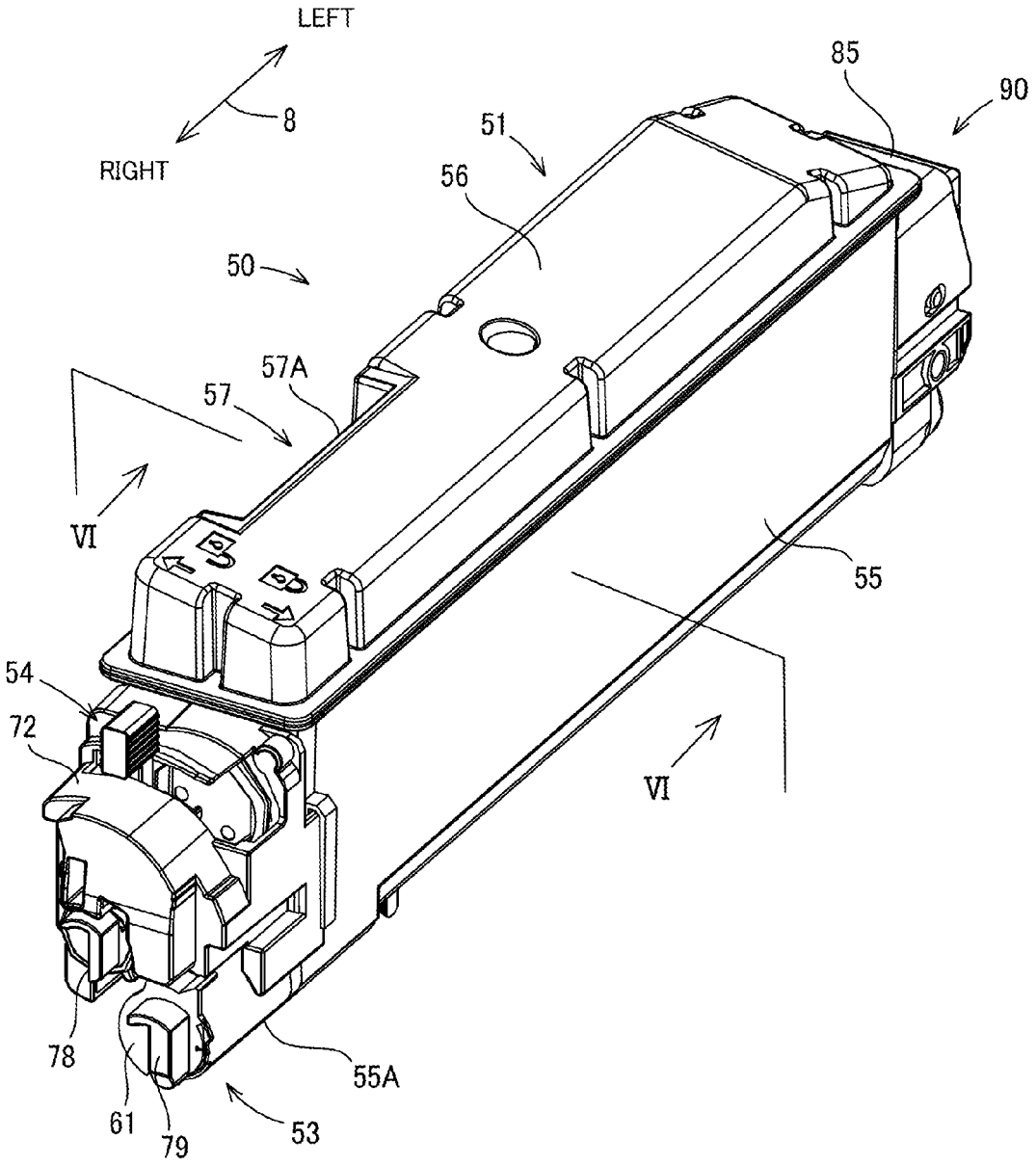
FIG. 5 is a diagram showing the toner container viewed from the right side.
Figure 6:
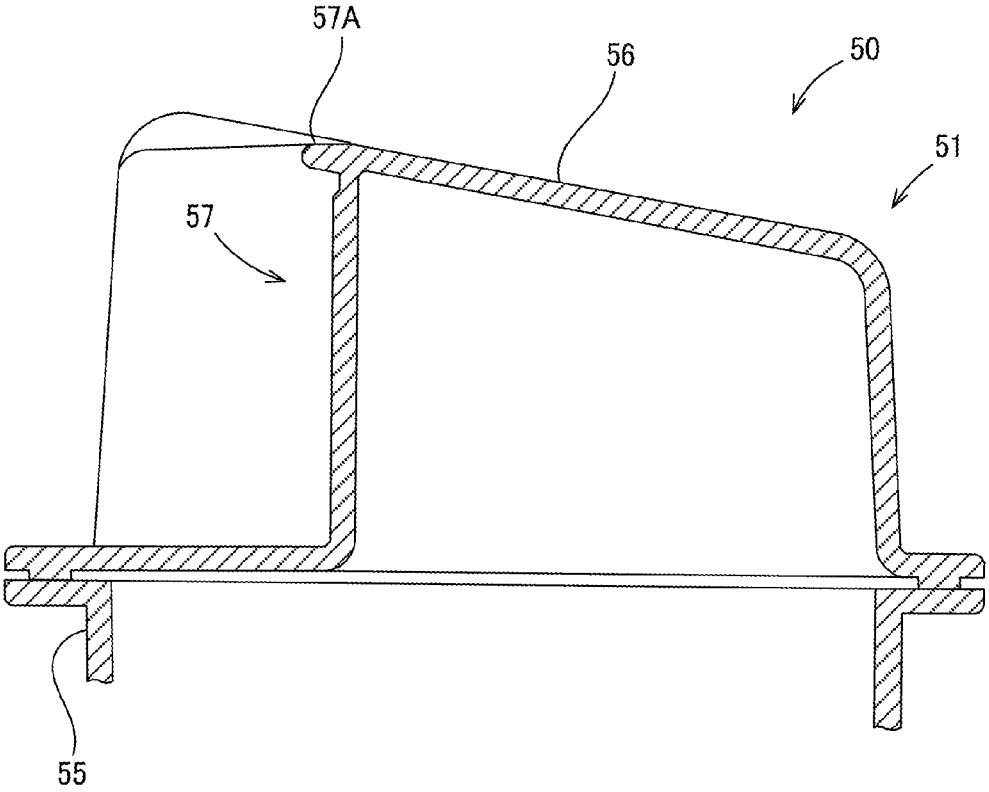
FIG. 6 is a sectional view taken along line VI-VI of FIG. 5 showing the configuration of a grip portion of the toner container.
Figure 7:
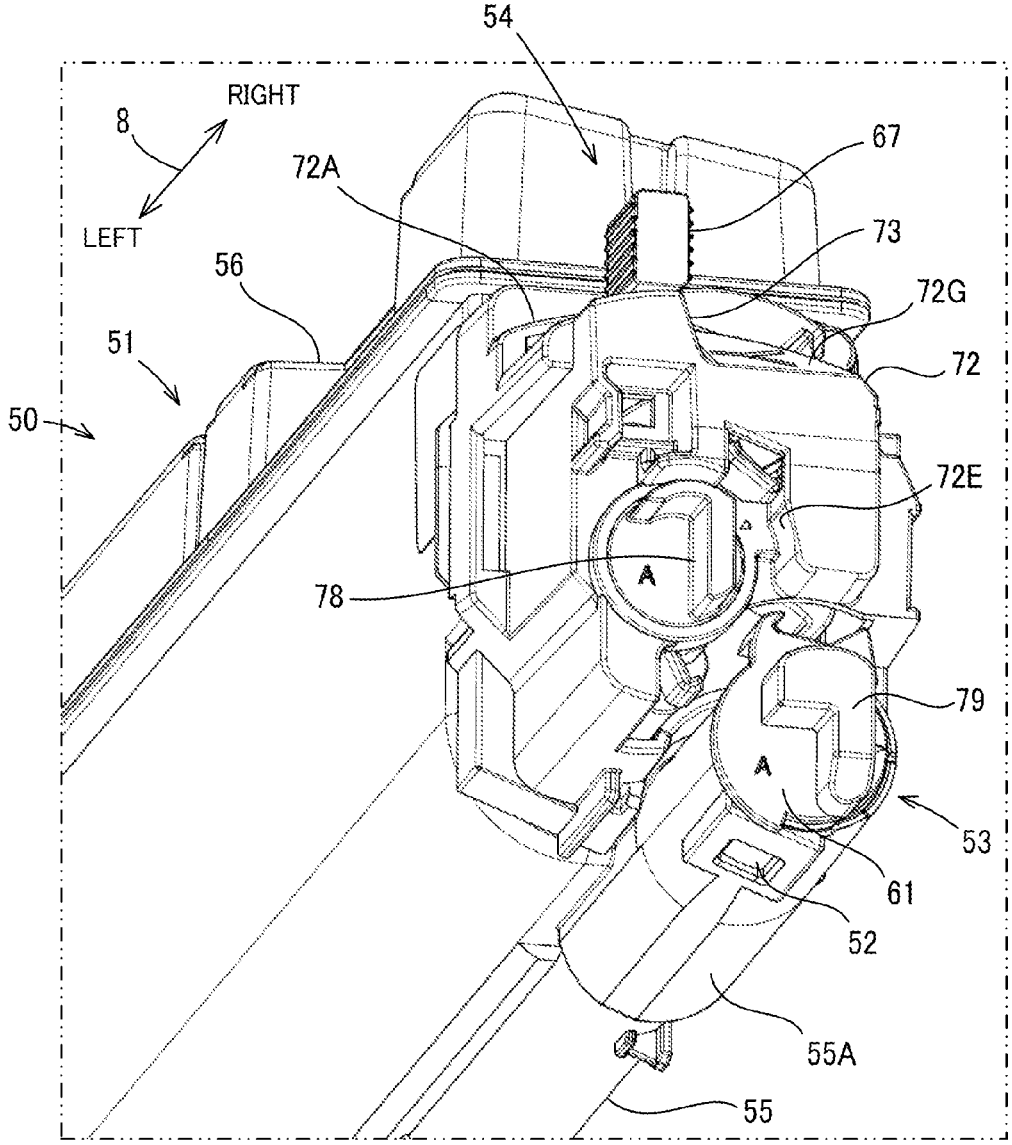
FIG. 7 is a diagram showing the right side part of the toner container.
Figure 8:
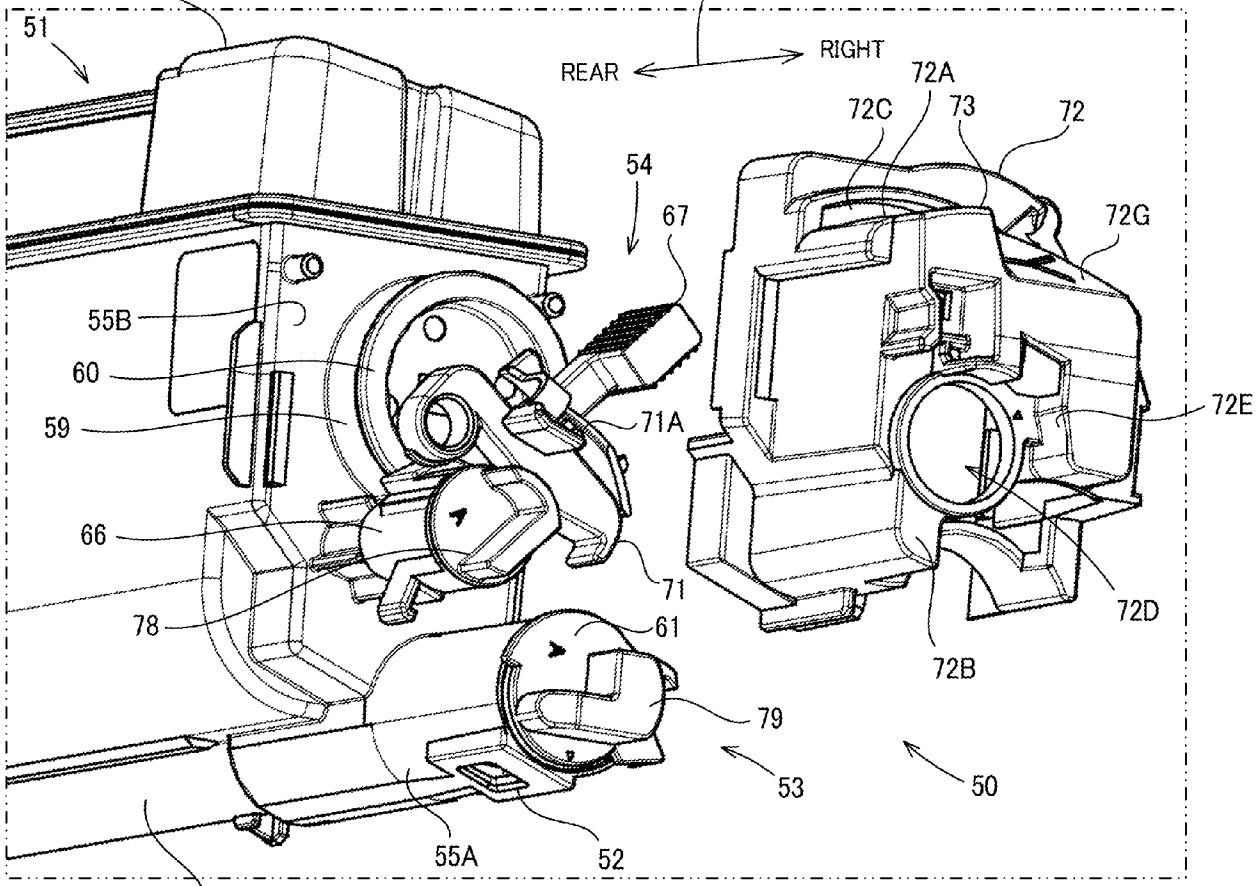
FIG. 8 is a diagram showing the state where a cover has been removed from the right side part of the toner container.

As shown in FIGS. 3 through 8, the toner container 50 includes a housing 51 as a container main body, a toner discharge outlet 52 (see FIG. 7), an opening/closing mechanism 53 (see FIG. 7), an operation portion 54, and a cover 72 as the cover portion. The housing 51 is attached to the attachment portion 40 of the image forming apparatus 10. The toner is stored in a storing chamber 68 (see FIGS. 16 and 17) that is formed partitioned in the housing 51. That is, an inner space of the housing 51 is the storing chamber 68. As shown in FIG. 7, the toner discharge outlet 52 is formed on the housing 51. The toner discharge outlet 52 is formed on the bottom of the housing 51 at the right end thereof. In addition, as shown in FIG. 8, the operation portion 54 is provided on the housing 51 so that it can be operated by the user.

Figure 3:
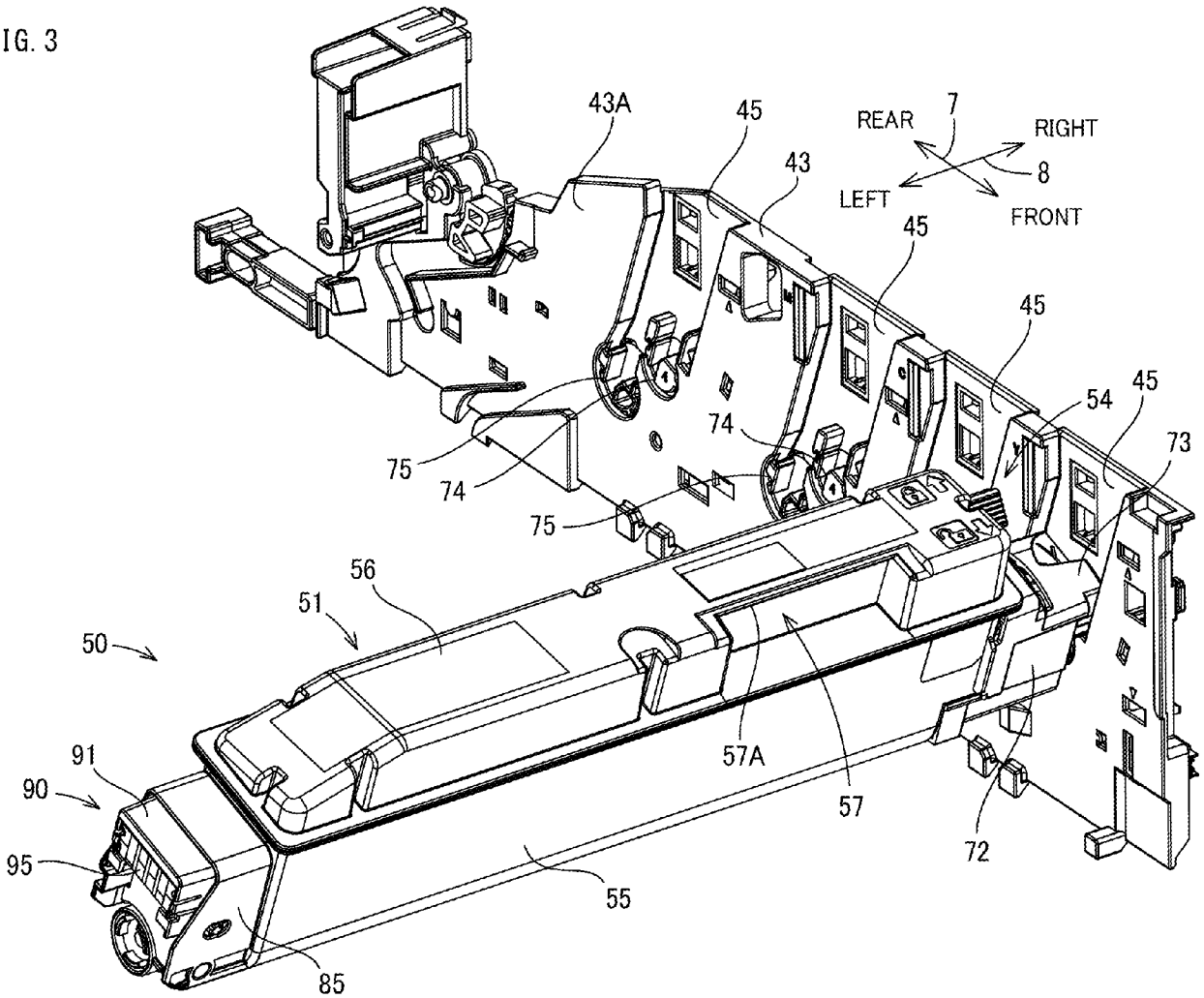
FIG. 3 is a diagram showing a toner container and the attachment portion.

As shown in FIGS. 2A through 3, the apparatus main body 28 includes support plates 42 and 43 to which the housing 51 is attached. The support plates 42 and 43 are formed plate-like, extending in the front-rear direction 7. The support plates 42 and 43 are disposed to face each other in the attachment portion 40. As shown in FIGS. 2A and 2B, the support plate 42 is erected at the left end of the attachment portion 40. As shown in FIG. 3, the support plate 43 is erected at the right end of the attachment portion 40. The support plates 42 and 43 support opposite ends of each of the four toner containers 50.

Figure 4:
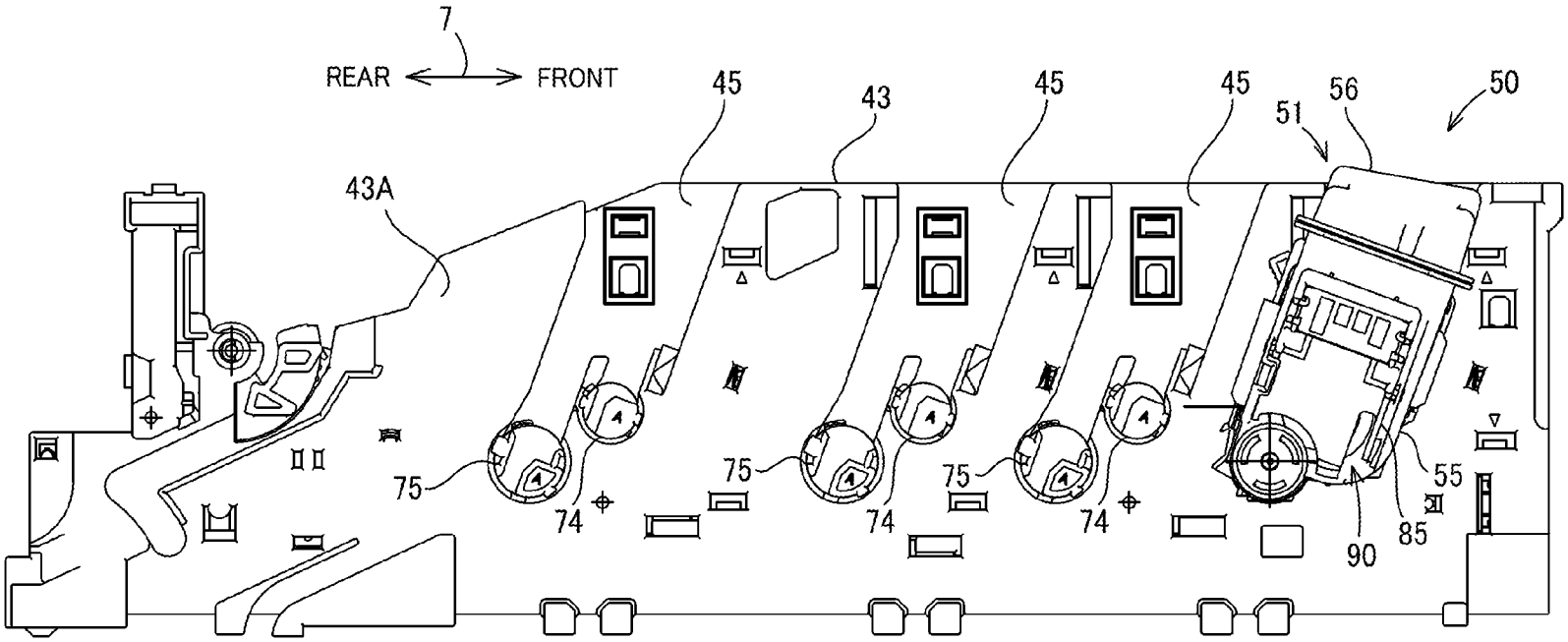
FIG. 4 is a diagram showing a toner container and the attachment portion.

As shown in FIGS. 3 and 4, on a left side surface 43A of a side (the left side) of the support plate 43, a plurality of container guides 45 are formed to extend diagonally upward. The container guides 45 are grooves formed by partially hollowing the left side surface 43A of the support plate 43 in the thickness direction. In addition, each container guide 45 is formed to spread upward at the upper part of the support plate 43. During the process of being attached to the support plate 43, the right end of the housing 51 is guided by the container guide 45 diagonally downward from the top.

The housing 51 is a storing part for storing toner. The housing 51 is made of a resin material, and is, as shown in FIG. 5, formed in the shape of a box elongated in the left-right direction 8. That is, the longitudinal direction of the housing 51 matches the left-right direction 8 of the image forming apparatus 10 shown in FIG. 1.

As shown in FIG. 5, the housing 51 includes a container main body 55 and a lid 56. The container main body 55 is formed in the shape of a box with a bottom, with the upper part thereof being opened. The lid 56 closes the upper opening of the container main body 55. The storing chamber 68 is formed partitioned by an outer peripheral wall of the container main body 55. In the storing chamber 68 inside the container main body 55, a stirring paddle (not shown) and a screw portion 58 (see FIG. 16) are provided, wherein the stirring paddle stirs the toner, and the screw portion 58 plays a role of a conveyance member for conveying the toner to the toner discharge outlet 52.

As shown in FIG. 5, the housing 51 includes a grip portion 57. The user grips the grip portion 57 when detaching the toner container 50 from the attachment portion 40, or attaching the toner container 50 to the attachment portion 40. The user grips the grip portion 57 to handle the toner container 50. The grip portion 57 is formed as a recess on a side of the lid 56 in the short direction. In the present embodiment, the grip portion 57 is a rectangular recessed part. As shown in FIG. 5, the grip portion 57 is provided at a position biased to an end of the lid 56 in the longitudinal direction. Specifically, the grip portion 57 is provided closer to the toner discharge outlet 52 of the toner container 50. As a result, when the user lifts the toner container 50 by one hand by gripping the grip portion 57, the toner container 50 forms an attitude where the end of the toner container 50 on the toner discharge outlet 52 side is located on the upper side, and the opposite end (an end at which a memory holder 90 described below is provided) is located on the lower side.

As shown in FIG. 6, on an upper edge of the grip portion 57, a projection rib 57A is provided to project in the short direction of the housing 51. The projection rib 57A projects approximately parallel to the upper surface of the lid 56. As shown in FIG. 5, the projection rib 57A extends in the longitudinal direction of the housing 51. The projection rib 57A is formed on, among the upper edges of the grip portion 57, an upper edge extending in the longitudinal direction of the housing 51. The projection rib 57A is formed as a part to which finger(s) of the user is hooked when the user grips the grip portion 57. The amount of projection of the projection rib 57A is set to a level that allows finger(s) of the user to be hooked when the user grips the grip portion 57 to hold the toner container 50. With the projection rib 57A provided in this way, the level of finger hooking is improved, and even when the grip portion 57 is provided at a position biased to an end in the longitudinal direction, the toner container 50 can be gripped, lifted and so on in a reliable manner.

It is noted that in the present embodiment, the grip portion 57 is provided on a side surface that faces the front side in the state where the toner container 50 is attached to the attachment portion 40. As a result, when opening the top cover 33 from the front side of the image forming apparatus 10 and handling the toner container 50, the user is to grip the grip portion 57 by hooking a thumb to the projection rib 57A of the grip portion 57.

It is noted that the grip portion 57 is not limited to a rectangular shape, but may have various shapes such as square or semicircular arc.

As shown in FIG. 8, the cover 72 is provided at the right end (the other end) of the container main body 55. In other words, the cover 72 constitutes the right end of the container main body 55. The cover 72 is provided to cover a right side wall 55B of the container main body 55. The side wall 55B is provided with a toner filling port 59 that is used to fill the housing 51 with toner. The toner filling port 59 is closed by a plug member 60.

As shown in FIGS. 7 and 8, the toner discharge outlet 52 is formed on the toner container 50. The toner discharge outlet 52 is formed at the right end of the bottom of the container main body 55. Specifically, a cylindrical portion 55A is formed on the side wall 55B that is at the right end of the container main body 55. The cylindrical portion 55A is provided on a lower part of the side wall 55B. The cylindrical portion 55A is formed approximately in the shape of a cylinder that projects and extends outside (rightward) from the side wall 55B. The inner space of the cylindrical portion 55A communicates with the inner space of the housing 51 in which the toner is stored. The cylindrical portion 55A is integrally formed with the container main body 55. The toner discharge outlet 52 is provided on the circumferential surface of the cylindrical portion 55A. More specifically, the toner discharge outlet 52 is provided on a lower part of the circumferential surface of the cylindrical portion 55A. The toner discharge outlet 52 is formed to vertically pass through a circumferential wall that constitutes the circumferential surface of the cylindrical portion 55A.

Figure 17:
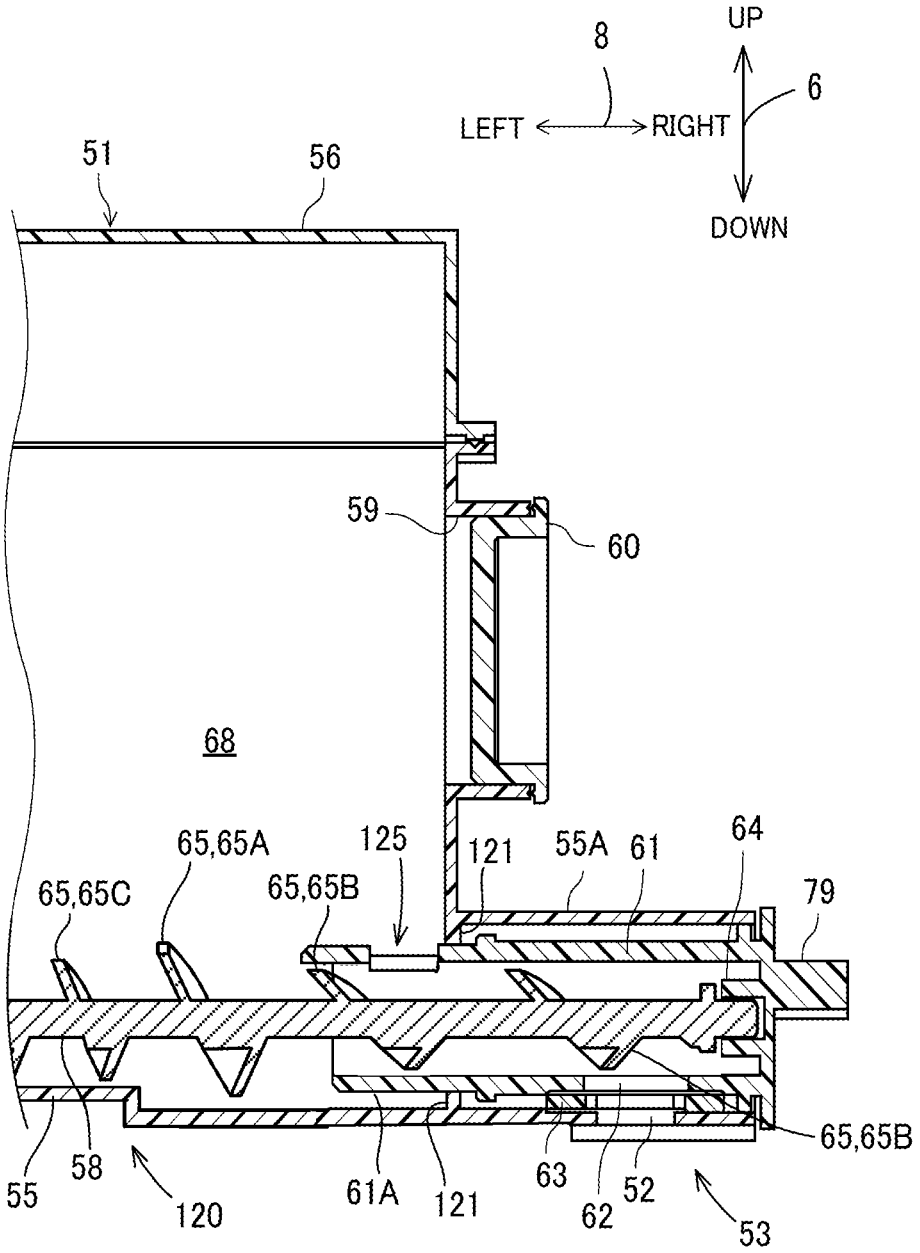
FIG. 17 is a sectional view showing the cross-sectional configuration of the right side of the toner container.
Figure 18:
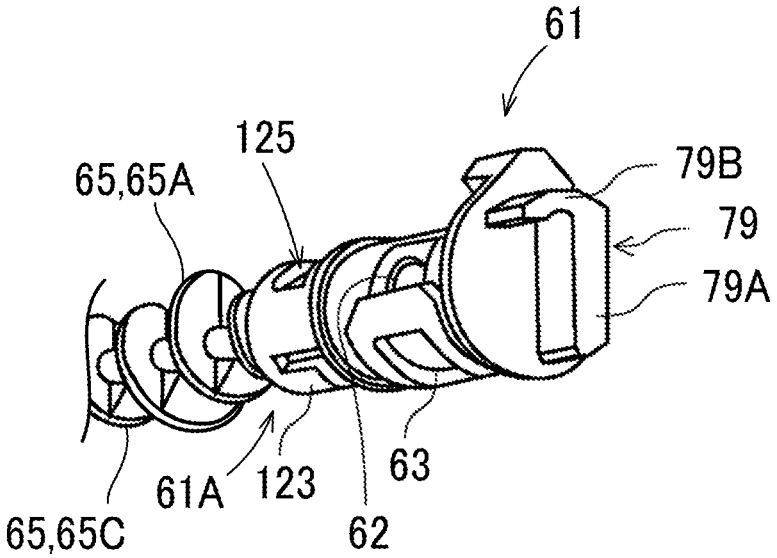
FIG. 18 is a diagram showing an opening/closing mechanism and a screw portion.

The opening/closing mechanism 53 is configured to open and close the toner discharge outlet 52. As shown in FIGS. 17 and 18, the opening/closing mechanism 53 includes a cylinder 61 as an opening/closing member, an opening 62, a seal member 63, and a second coupling portion 79. The cylinder 61 is provided in the inner space of the cylindrical portion 55A. The cylinder 61 is formed in the shape of a cylinder that is concentric with the cylindrical portion 55A, and is inserted into the cylindrical portion 55A provided at the right end of the container main body 55. The cylinder 61 is configured to rotate around the cylindrical axis of the cylindrical portion 55A and sliding contact the inner circumferential surface of the cylindrical portion 55A. When a driving force is input to the cylinder 61 via the second coupling portion 79, the cylinder 61 rotates, opening and closing the toner discharge outlet 52.

As shown in FIG. 17, the right end of the cylinder 61 is closed and formed like a lid. That is, the right end of the cylinder 61 plays a role of a lid that closes the opening of the cylindrical portion 55A on the right side thereof. In addition, the right end of the cylinder 61 is integrally provided with the second coupling portion 79. The opening 62 is formed on the outer circumferential surface of the cylinder 61. The opening 62 is formed at a position that overlaps with the toner discharge outlet 52. In addition, the seal member 63 is provided on the inner wall surface of the cylindrical portion 55A at the peripheral of the toner discharge outlet 52. The seal member 63 is provided to prevent scattering of toner.

The cylinder 61 is rotatably attached to the cylindrical portion 55A. When a rotational force is input to the second coupling portion 79, the cylinder 61 rotates. When, as the cylinder 61 rotates, the opening 62 of the cylinder 61 overlaps with the toner discharge outlet 52, the toner discharge outlet 52 is opened as shown in FIG. 17. Hereinafter, the position of the cylinder 61 (the position shown in FIG. 17) that allows the toner discharge outlet 52 to be opened is referred to as an "opening position". When the cylinder 61 rotates and reaches the opening position, toner in the housing 51 can be discharged from the toner discharge outlet 52 to outside. On the other hand, when the cylinder 61 rotates to a position where the circumferential wall other than the opening 62 of the cylinder 61 overlaps with the toner discharge outlet 52, the toner discharge outlet 52 is closed by the circumferential wall of the cylinder 61. Hereinafter, the position of the cylinder 61 that allows the toner discharge outlet 52 to be closed is referred to as a "closing position". When the cylinder 61 rotates and reaches the closing position, the toner discharge outlet 52 is closed.

A bearing 64 is formed inside the cylinder 61 at the right end thereof. An end of the screw portion 58 is supported by the bearing 64 so as to be rotatable inside the cylinder 61.

Figure 16:
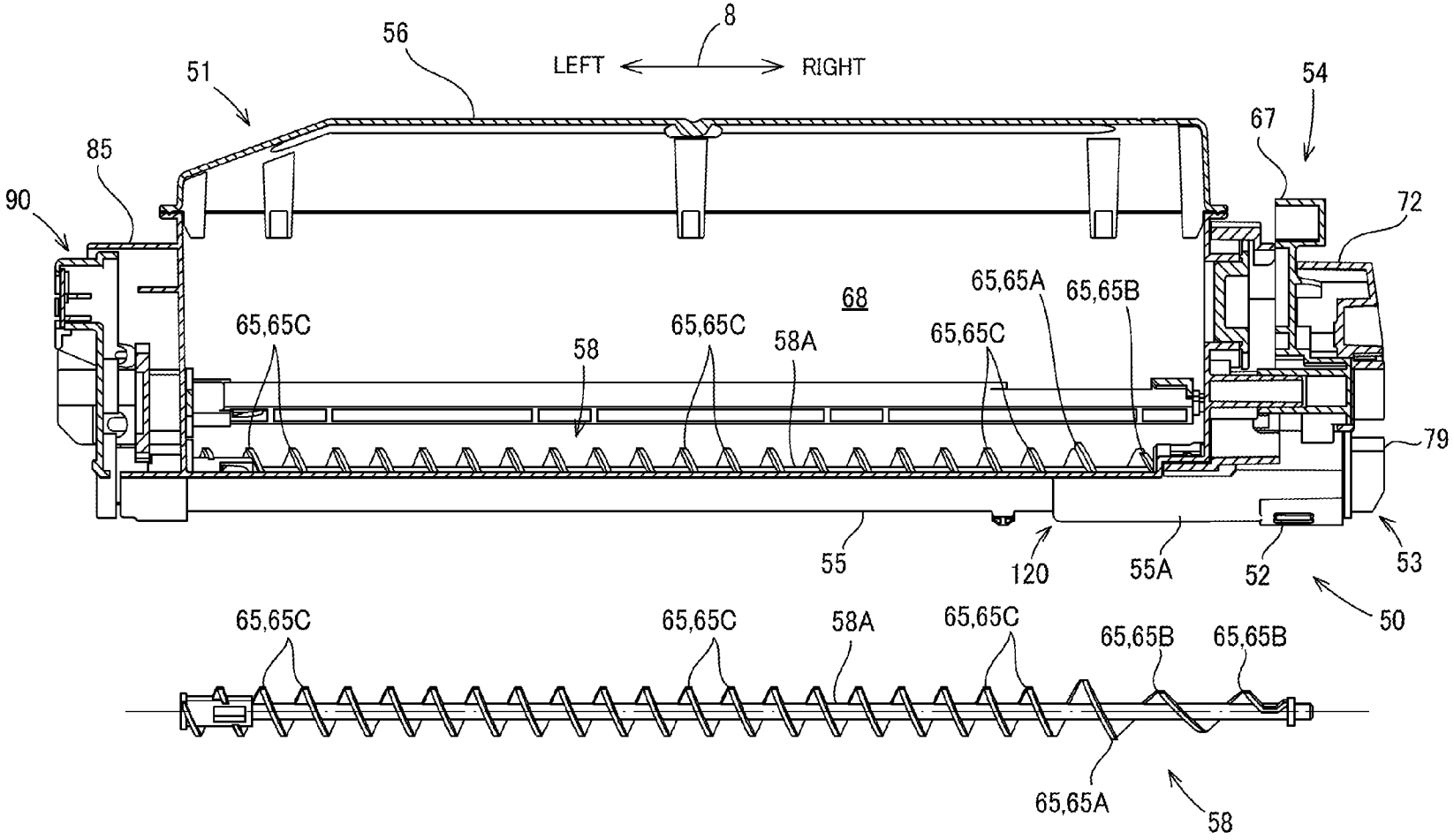
FIG. 16 is a sectional view showing the cross-sectional configuration of the toner container in the longitudinal direction.

When being rotated, the screw portion 58 conveys toner from inside of the housing 51 to inside of the cylindrical portion 55A, and further toward the toner discharge outlet 52. As shown in FIGS. 16 and 17, the screw portion 58 is disposed on the bottom of the storing chamber 68 of the container main body 55. As a result, the bottom of the container main body 55 is formed in the shape of semicircular arc in correspondence with the rotary orbit of a blade 65 of the screw portion 58.

The screw portion 58 is elongated, extending in the longitudinal direction of the container main body 55, and is provided in a region that extends from the storing chamber 68 of the housing 51 to the inner space of the cylindrical portion 55A. An end of a rotation shaft 58A of the screw portion 58 is rotatably supported by the bearing 64 of the cylindrical portion 55A, and the other end is rotatably supported by a side wall 55C of the container main body 55 at the other end in the longitudinal direction. In this way, the screw portion 58 is supported to be rotatable in the housing 51. The other end of the rotation shaft 58A of the screw portion 58 passes through the side wall 55C and is coupled with a shaft coupling 69. The shaft coupling 69 is a portion to which a rotational driving force is input from the apparatus main body 28 in the state where the toner container 50 is attached to the attachment portion 40. When the rotational driving force is supplied to the rotation shaft 58A via the shaft coupling 69, the screw portion 58 is rotated.

Meanwhile, in the case where the toner discharge outlet 52 is formed on the cylindrical portion 55A that projects outside (rightward) from the side wall 55B of the container main body 55, a large load is applied when toner is conveyed from the storing chamber 68 of the housing 51 into the cylindrical portion 55A. As a result, a sufficient amount of toner may not be conveyed from the storing chamber 68 into the cylindrical portion 55A. In addition, due to the limited space in the cylindrical portion 55A, the blade 65 of the screw portion 58 cannot be made large enough. In that case, toner conveyed into the cylindrical portion 55A may not be smoothly conveyed to the toner discharge outlet 52. In view of this, as described below, the toner container 50 of the present disclosure is configured to convey toner smoothly from the storing chamber 68 to the toner discharge outlet 52.

The screw portion 58 includes a plurality of blades 65 along the axis direction of the rotation shaft 58A. The blades 65 may be provided continually along the axis direction of the rotation shaft 58A in the helical shape, or may be provided independently of each other along the axis direction. In the present embodiment, the screw portion 58 has three types of blades 65 (65A, 65B and 65C). That is, the screw portion 58 includes a first blade 65A, second blades 65B and third blades 65C that are different from each other in shape.

As shown in FIG. 17, the first blade 65A is larger in blade size than the other blades 65*b* and 65C. The size of the blades 65 of the screw portion 58 is an element that determines the toner conveyance amount in the storing chamber 68. As a result, since the first blade 65A is larger than the other blades 65*b* and 65C, the first blade 65A is larger in toner conveyance amount than the other blades 65*b* and 65C. The first blade 65A is disposed in the storing chamber 68 of the housing 51. More specifically, in the storing chamber 68, the first blade 65A is disposed at a position that is closest to the cylindrical portion 55A side. Here, as described below, the cylinder 61 stored in the cylindrical portion 55A includes a projection 61A that partially projects from a boundary between the storing chamber 68 and the inner space of the cylindrical portion 55A, toward the storing chamber 68 side. As a result, in the storing chamber 68, the first blade 65A is disposed at a position that is closest to the projection 61A of the cylinder 61. It is noted that, when the cylinder 61 does not have a shape that is projecting from the cylindrical portion 55A, the first blade 65A is disposed at a position that is closest to the boundary between the storing chamber 68 and the inner space of the cylindrical portion 55A. In the present embodiment, the first blade 65A is a helical part that turns around the circumference of the rotation shaft 58A once.

Here, as described above, the screw portion 58 is disposed on the bottom of the container main body 55. As a result, if the first blade 65A is made larger in size than the other blades 65B and 65C, the tip of the first blade 65A would come into contact with the bottom of the storing chamber 68. On the other hand, if it is configured such that the tip of the first blade 65A does not contact the bottom of the storing chamber 68, the third blades 65C would be in a floated state from the bottom of the storing chamber 68 and toner that cannot be conveyed is collected on the bottom of the storing chamber 68. In view of this, in the present embodiment, on the bottom of the storing chamber 68, in a region corresponding to the first blade 65A, a stepped portion 120 is provided to expand the space of the storing chamber 68 lower than the rotation shaft 58A such that the first blade 65A can be disposed. With this configuration, the first blade 65A does not contact the bottom of the storing chamber 68, while making it possible to convey the toner to the toner discharge outlet 52 without allowing the toner to remain in the storing chamber 68.

As shown in FIG. 17, the stepped portion 120 is formed to continue to the outer circumferential surface of the cylindrical portion 55A. Thus, inside the cylindrical portion 55A, the storage space of the cylinder 61 is expanded, and the second blades 65B are made to be as large as possible in the cylinder 61, although with some restriction.

In the storing chamber 68, the third blades 65C are disposed to be further away from the cylindrical portion 55A than the first blade 65A. The third blades 65C are smaller in size than the first blade 65A, and are helical parts formed to continue from the first blade 65A to an end opposite to the cylindrical portion 55A. The first blade 65A and the third blades 65C are both inclined with the same inclination angle with respect to the rotation shaft 58A.

The second blades 65B are disposed in the inner space of the cylinder 61. The second blades 65B are formed to be smaller in blade size than the other blades 65A and 65C. This is because the inner space of the cylinder 61 is restricted by the outer circumferential wall. It is noted that it is possible to increase the size of the second blades 65B by increasing the inner space of the cylinder 61 in the radial direction by increasing its inner diameter. However, in that case, a large load is applied to the cylinder 61 operating as the opening/closing member. This may cause a failure to the opening/closing of the toner discharge outlet 52. In view of this, in the present embodiment, the cylindrical portion 55A and the cylinder 61 are made relatively small in inner diameter to ensure a smooth operation of opening and closing. On the other hand, toner conveyed into the cylinder 61 is conveyed therein by the second blades 65B of the small size. As described above, the size of the blades 65 is an important element that determines the toner conveyance amount in the storing chamber 68. Accordingly, due to the small size, the second blades 65B may not smoothly and sufficiently convey the toner that has been conveyed by the first blade 65A, to the toner discharge outlet 52. Therefore the second blades 65B are provided on the rotation shaft 58A with a larger inclination angle (inclination angle with respect to the rotation shaft 58A) than the first blade 65A and the third blades 65C. Furthermore, the size of the second blades 65B is set such that the gaps between the tips of the second blades 65B and the inner wall of the cylinder 61 are very small. It is noted here that the inclination angle of the blades 65 with respect to the rotation shaft 58A affects the conveyance speed of toner when it is conveyed in the axis direction under the condition where, as in the inner space of the cylinder 61, the toner cannot escape in the radial direction of the rotation shaft 58A. That is, in the cylinder 61, the larger the inclinatin angle is, namely the closer the blade is to the rotation shaft 58A, the higher the toner conveyance speed is.

The first blade 65A, second blades 65B and third blades 65C are provided on the screw portion 58 in the above-described manner. This enables a larger amount of toner to be conveyed from the storing chamber 68 to the cylindrical portion 55A stably in a reliable manner, and enables toner to be conveyed smoothly in the cylindrical portion 55A and the cylinder 61 to the toner discharge outlet 52.

As shown in FIGS. 17 through 19B, the cylinder 61 includes a projection 61A. The projection 61A is a part that partially projects from the boundary between the storing chamber 68 and the inner space of the cylindrical portion 55A toward the storing chamber 68 side. The projection 61A plays a role of fixing the cylinder 61 to the cylindrical portion 55A.

Figure 19A:
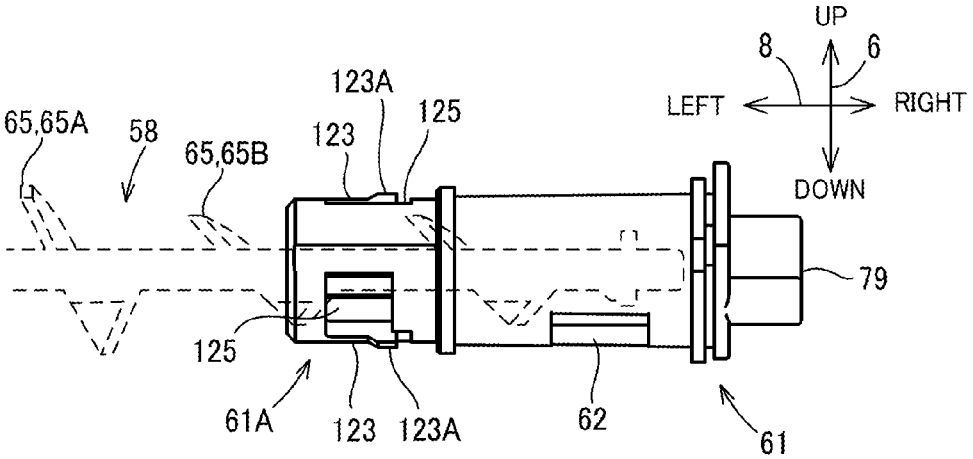
FIGS. 19A and 19B are diagrams showing the opening/closing mechanism and the screw portion.
Figure 19B:
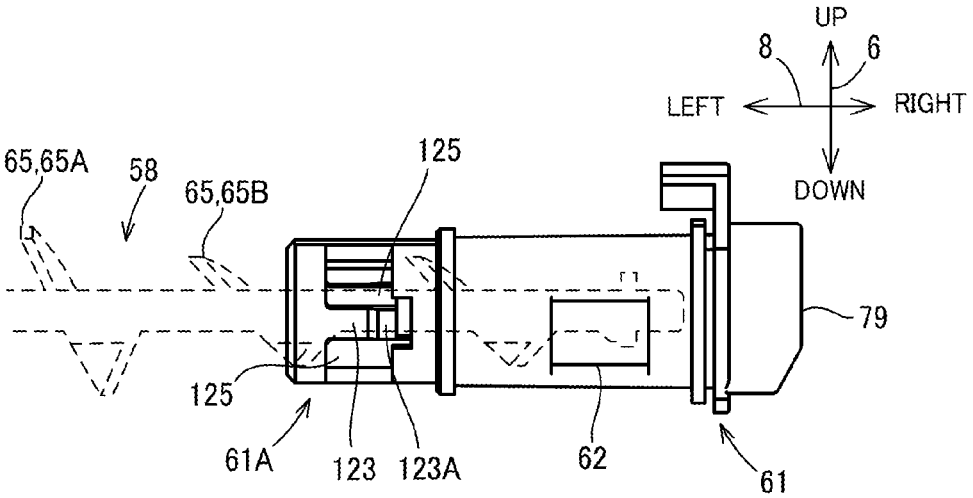

Specifically, an annular abutting rib 121 (see FIG. 17) is provided at an opening of the cylindrical portion 55A on the storing chamber 68 side. The abutting rib 121 is provided in the vicinity of the boundary between the storing chamber 68 and the inner space of the cylindrical portion 55A, and is projecting from the inner surface of the cylindrical portion 55A toward the cylindrical center of the cylindrical portion 55A. The tip of the abutting rib 121 abuts on the circumferential surface of the cylinder 61 and the circumferential surface of the projection 61A. As shown in FIGS. 19A and 19B, two snap fits 123 are formed on the outer circumferential surface of the projection 61A, wherein the snap fits 123 are configured to be engaged with the abutting rib 121. Cuts 125 are formed as cuts in the peripheral of the snap fits 123. The cuts 125 are formed to provide the snap fits 123 with elasticity. The cuts 125 are cut grooves that are formed when the snap fits 123 are formed on the circumferential surface of the projection 61A. Engaging projections 123A configured to be engaged with the abutting rib 121 are provided on the cylindrical portion 55A side of the snap fits 123, and the other side of the snap fits 123 is joined with the projection 61A. This makes it possible for the engaging projections 123A to swing as free ends. With such configuration of the snap fits 123, when the cylinder 61 is inserted into the cylindrical portion 55A and the projection 61A passes the abutting rib 121, the snap fits 123 are bent inward and deflected. Subsequently, when the engaging projections 123A pass the abutting rib 121, the snap fits 123 return to the original shape by the elasticity, and the engaging projections 123A are engaged with the abutting rib 121. With this engagement, the cylinder 61 is fixed to the cylindrical portion 55A in the state where it is stored in the cylindrical portion 55A. As a result, the cylinder 61 is prevented from slipping out from the cylindrical portion 55A easily.

As shown in FIGS. 19A and 19B, two cuts 125 are formed on the circumferential surface of the projection 61A at positions corresponding to the two snap fits 123. The cuts 125 are formed opposite to each other on the outer circumferential surface of the projection 61A. In the present embodiment, when the cylinder 61 is at the opening position (the position shown in FIG. 17) for opening the toner discharge outlet 52, at least one of the cuts 125 is positioned at the top of the circumferential surface of the projection 61A, as shown in FIG. 19A. At this time, the other cut 125 is positioned at the bottom of the projection 61A. Here, FIG. 19A shows the position of the cylinder 61 when the toner discharge outlet 52 is opened, and FIG. 19B shows the position of the cylinder 61 when the toner discharge outlet 52 is closed.

Since the cuts 125 configured to be positioned as described above are provided on the projection 61A, when toner stored in the storing chamber 68 is moved to the upper part of the projection 61A, the toner passes through the cut 125 to enter the cylinder 61 and conveyed to the toner discharge outlet 52. It is noted that if the upper cut 125 is not provided, toner would be collected on the upper part of the projection 61A, and the collected toner would remain without being discharged. However, according to the present embodiment, the cuts 125 are provided on the projection 61A, thus it is possible to prevent the collected toner from wastefully remaining in the storing chamber 68. In addition, since two cuts 125 are provided on the projection 61A, even if excessive toner is pushed into the projection 61A by the screw portion 58, the toner can escape from the cuts 125, thereby preventing the toner from adhering inside the cylinder 61.

In the projection 61A, the lower cut 125 is formed to be an opening larger in size than the upper cut 125. This allows the toner to escape from the lower cut 125 even if the gap between the projection 61A and the bottom of the storing chamber 68 is very small.

The cylinder 61 is configured to be displaced between the opening position and the closing position with the rotation of the second coupling portion 79. The toner discharge outlet 52 is opened and closed with the rotation of the cylinder 61. When the toner container 50 is attached to the attachment portion 40, the second coupling portion 79 is coupled with a driving transmission mechanism 76 (see FIGS. 11 through 16) that is provided in the apparatus main body 28 (more specifically, in the attachment portion 40). This allows the second coupling portion 79 to receive the rotational force from the driving transmission mechanism 76. It is noted that the driving transmission mechanism 76 and the second coupling portion 79 are described in detail below.

When the toner container 50 is attached to the attachment portion 40, the toner discharge outlet 52 is positioned to face a communication opening (not shown) formed on the intermediate transfer unit 22, and is brought into close contact with the communication opening. This allows toner to be supplied to the developing device 12 via the communication opening and a conveyance path (not shown). The attachment position of the toner container 50 in the attachment portion 40 is determined such that the above-described positional relationship is satisfied.

As shown in FIG. 8, the operation portion 54 is provided at the right end of the container main body 55. The operation portion 54 is used to open and close the toner discharge outlet 52 in the state where the toner container 50 is attached to the attachment portion 40 at the attachment position. The operation portion 54 includes a shaft 66 and a lever 67. The shaft 66 is rotatably supported by the side wall 55B of the container main body 55. The lever 67 is a bar-like member fixed to the shaft 66 and extending from the shaft 66.

The shaft 66 includes a shaft core that projects rightward from the right end of the housing 51. The lever 67 is pivotable, integrally with the shaft 66, around the shaft core of the shaft 66. In the present embodiment, the operation portion 54 is pivotable between a first operation position at which the lever 67 is tilted frontward (the attitude shown in FIG. 9A) and a second operation position (the attitude shown in FIG. 9B) at which the lever 67 is tilted rearward. With the operation of the lever 67 between the first operation position and the second operation position, the cylinder 61 of the opening/closing mechanism 53 is moved to the closing position that corresponds to the first operation position, or the opening position that corresponds to the second operation position. Here, the first operation position is an attitude corresponding to the closing position of the cylinder 61. More specifically, the lever 67 is positioned at the first operation position to maintain or dislocate the cylinder 61 at/to the closing position. On the other hand, the second operation position is an attitude corresponding to the opening position of the cylinder 61. More specifically, the lever 67 is positioned at the second operation position to maintain or dislocate the cylinder 61 at/to the opening position.

A lock member 71 is provided at the right end of the container main body 55. The lock member 71 locks the operation portion 54 and the opening/closing mechanism 53 to prevent them from mulfunctioning. That is, the lock member 71 locks the operation portion 54 so that the operation of the operation portion 54 is restricted. Furthermore, the lock member 71 locks the opening/closing mechanism 53 so that the opening/closing operation of the opening/closing mechanism 53 is restricted. A releasing portion 71A is integrally formed with the lock member 71, wherein the releasing portion 71A has a shape of a claw projecting rightward. It is noted that the lock member 71 is not described in detail since it is not a main configuration of the present disclosure.

As shown in FIGS. 7 and 8, the cover 72 is attached to the right side wall 55B of the container main body 55. The cover 72 is attached so as to cover the base part of the lever 67, the lock member 71 and the like. A slit 72C in the circular arc shape is formed on an upper surface 72A of the cover 72. The slit 72C is a through groove that extends to be elongated in the front-rear direction 7 on the upper surface 72A. The upper end of the lever 67 is exposed upward from the slit 72C. As a result, when operated, the lever 67 is moved along and guided by the slit 72C between the first operation position and the second operation position.

Figure 9A:
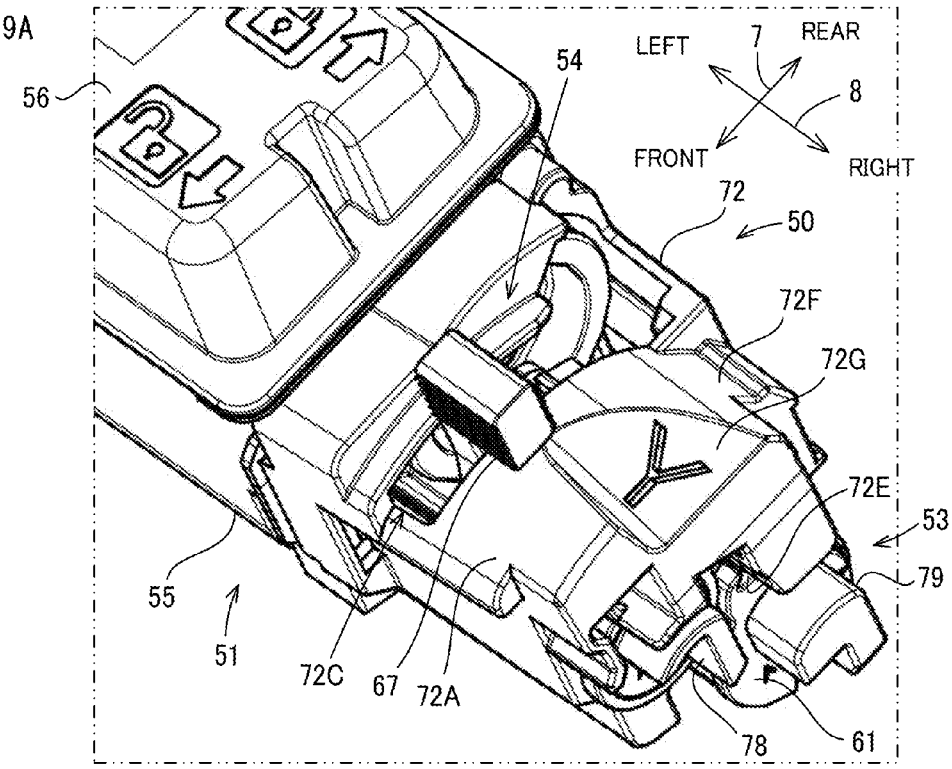
FIG. 9A is a diagram showing the state before a lever of an operation portion is rotationally operated.
Figure 9B:
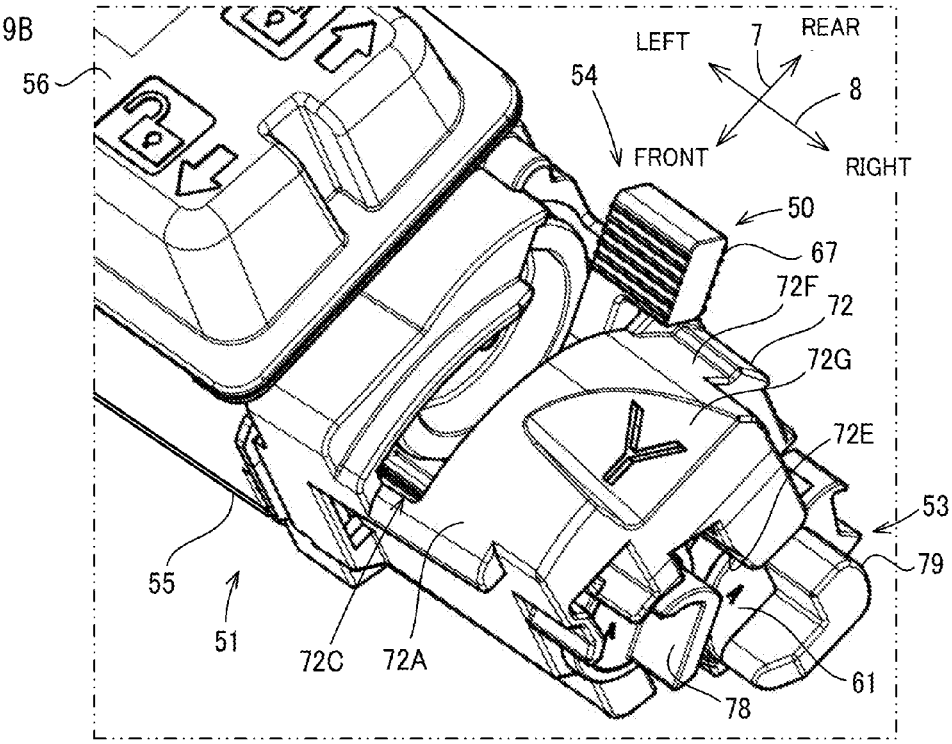
FIG. 9B is a diagram showing the state after the lever of the operation portion is rotationally operated.

As shown in FIGS. 9A and 9B, a guide portion 72F is provided on the upper surface 72A more on the right side than the slit 72C, wherein the guide portion 72F is curved downward on the rear side. The guide portion 72F extends from near the center of the upper surface 72A of the cover 72 in the front-rear direction 7 to the rear wall of the cover 72. The curved surface on the upper surface of the guide portion 72F has a circular arc shape whose center is the shaft core of the shaft 66. The guide portion 72F is formed in a shape widening from near the center of the upper surface 72A toward the rear. In other words, the guide portion 72F is formed in a shape tapering from the rear toward the front. With the guide portion 72F configured as such, when the user picks up the lever 67 between thumb and forefinger and moves it from the first operation position to the second operation position, the user can operate it while allowing the other fingers to contact and slide on the curved surface of the guide portion 72F. This enables the user to stable the attitude of his/her hand and fingers picking up the lever 67, thereby enabling the lever 67 to be rotationally operated smoothly.

In addition, on the cover 72, an inclined surface 72G is formed more on the right side than the guide portion 72F, wherein the inclined surface 72G is tapered and inclined diagonally downward. The inclined surface 72G is more inclined downward than the upper surface 72A of the cover 72. More specifically, the inclined surface 72G is more inclined downward than the curved surface on the upper surface of the guide portion 72F. As a result, when picking up and operating the lever 67, the user can put his/her fingers on the inclined surface 72G. With the inclined surface 72G formed as such, when the user operates and moves the lever 67 from the second operation position to the first operation position, the user can operate the lever 67 smoothly because the fingers that are not used in the operation are not caught by the upper surface 72A of the cover 72.

Figure 10B:
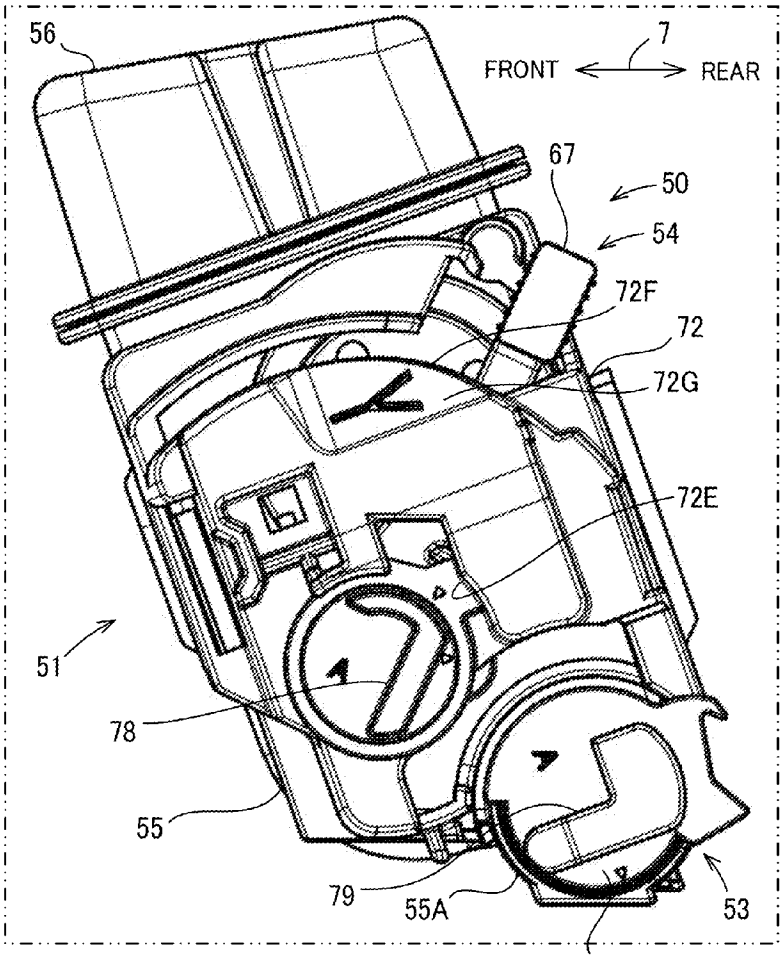
FIGS. 10A and 10B show positions of the first coupling portion and the second coupling portion corresponding to the operation positions of the lever of the operation portion.
Figure 10A:
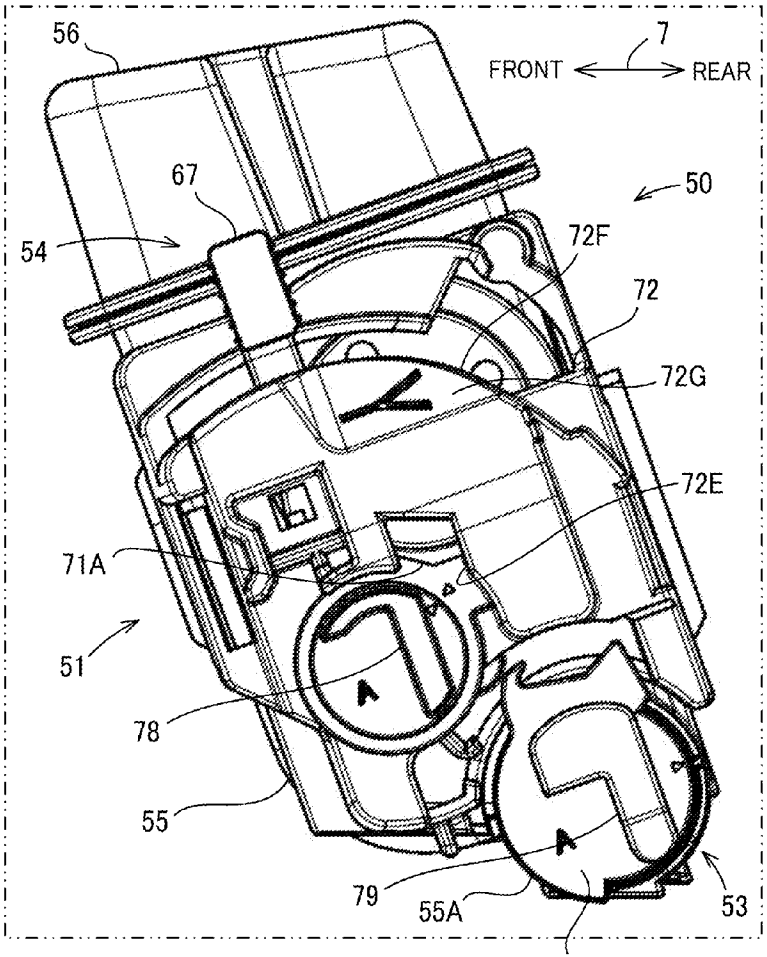

An opening 72D is formed on a right side surface 72B of the cover 72. A first coupling portion 78 that is described below is projecting from the opening 72D and exposed to outside on the right side. In addition, on the right side surface 72B, a guide groove 72E is formed, wherein the guide groove 72E extends vertically and is opened downward. As shown in FIG. 10A, the releasing portion 71A of the lock member 71 is exposed to outside of the cover 72 through the guide groove 72E. It is noted that the second coupling portion 79 of the cylinder 61 is not covered with the cover 72.

As shown in FIG. 8, the cover 72 includes a positioning projection 73 that is in the shape of a block and projecting rightward from the right end of the container main body 55. The positioning projection 73 has a width which allows it to be fitted in the container guide 45 (see FIG. 3), the width being slightly smaller than the groove width of the container guide 45. This enables the positioning projection 73 to be attached to the container guide 45. Specifically, as shown in FIG. 3, when the positioning projection 73 is fitted in the container guide 45 and guided by the container guide 45 diagonally downward, the housing 51 is attached to the support plate 43.

Figure 11:
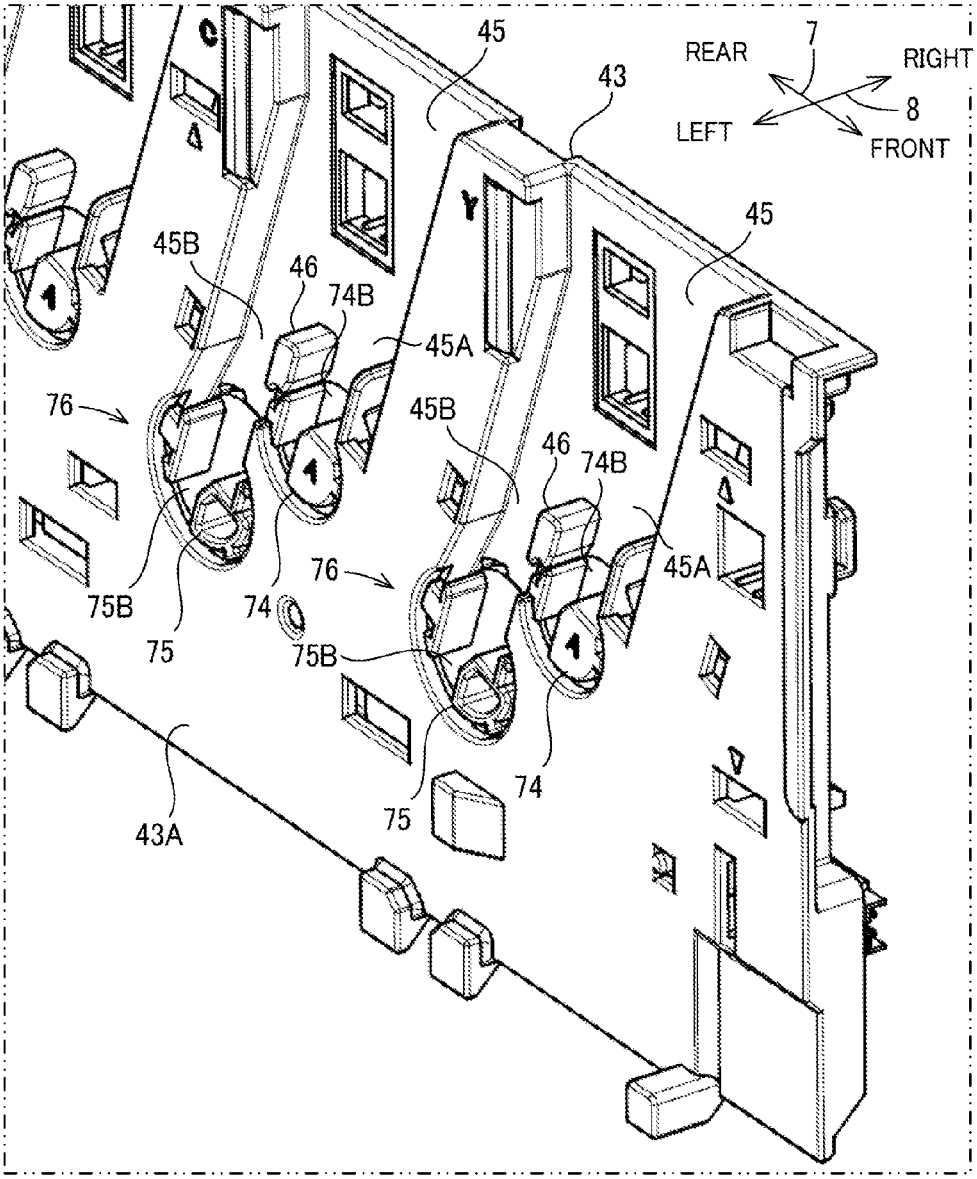
FIG. 11 is a diagram partially showing the configuration of the left side of a support plate of the attachment portion.
Figure 12A:
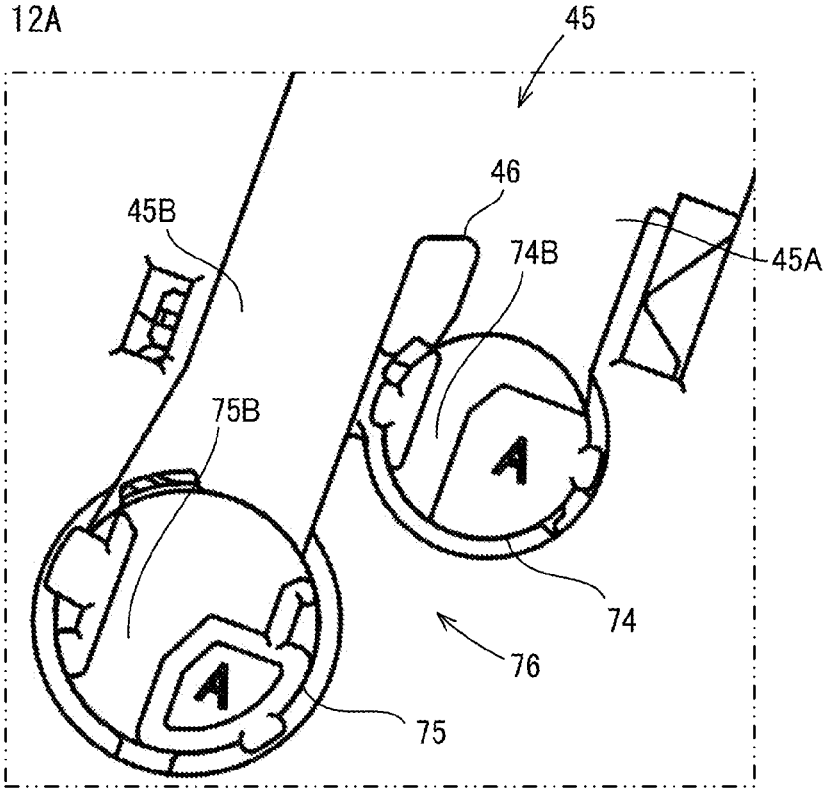
FIGS. 12A and 12B are expanded views of a driving transmission mechanism provided on the support plate.
Figure 12B:
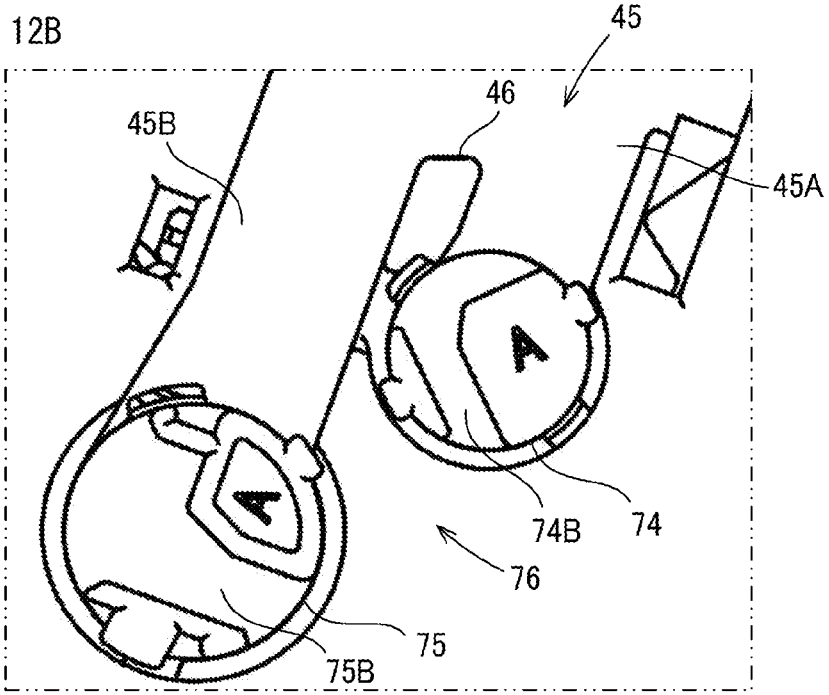
Figure 13:
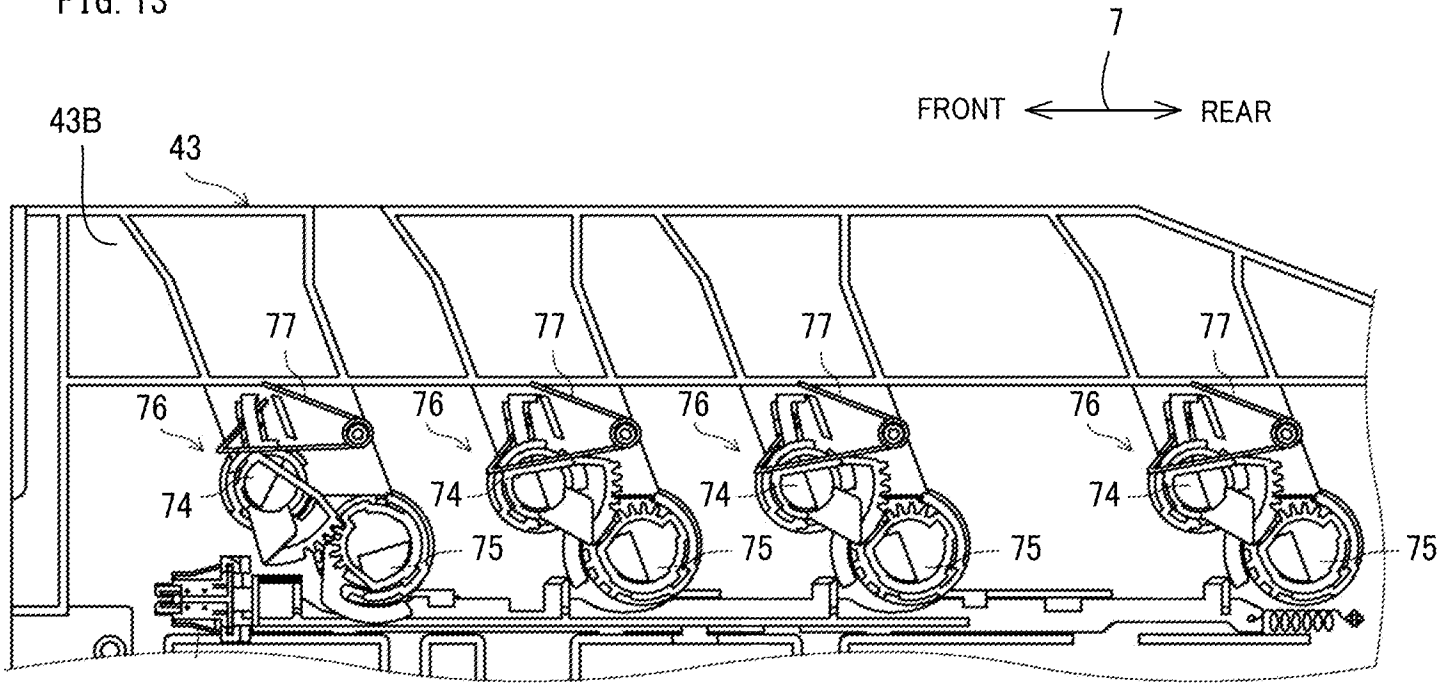
FIG. 13 is a diagram showing the configuration of the right side of the support plate of the attachment portion.
Figure 14:
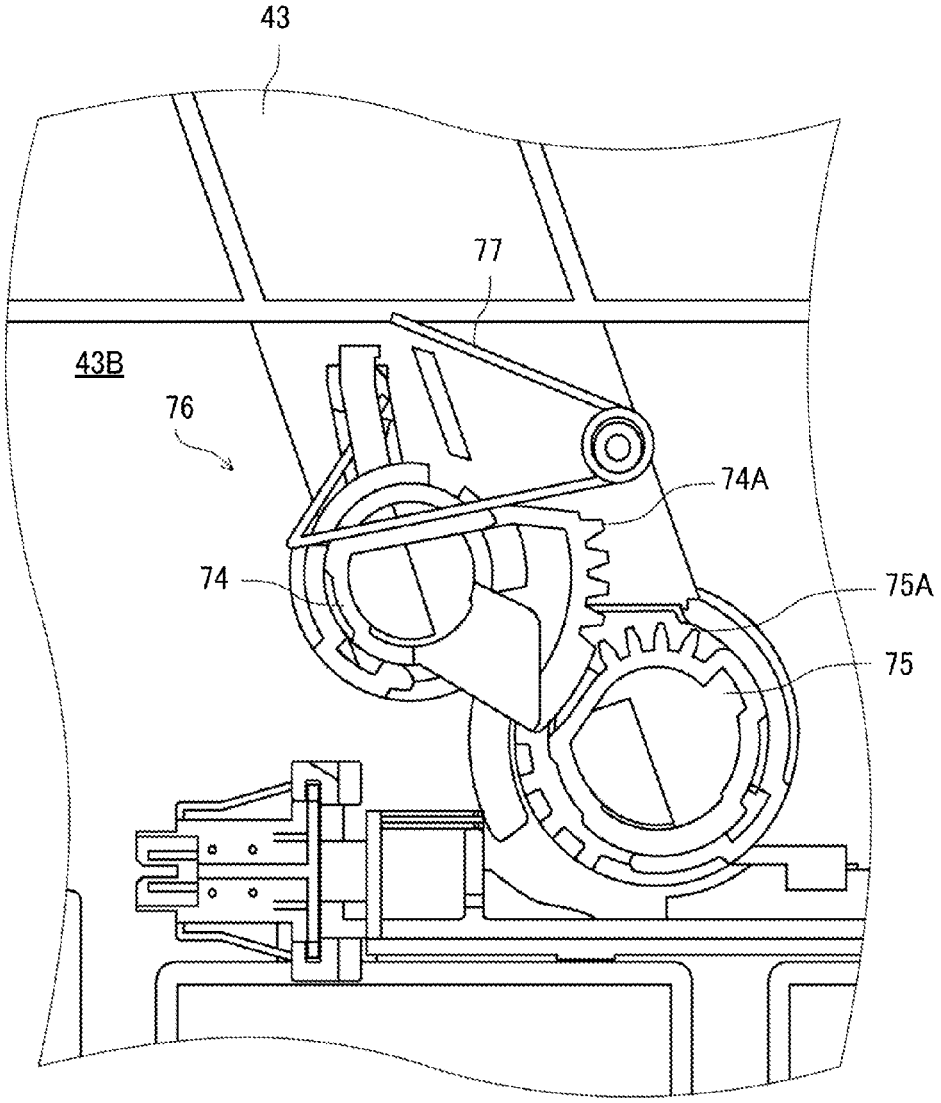
FIG. 14 is an expanded view of the driving transmission mechanism.
Figure 15:
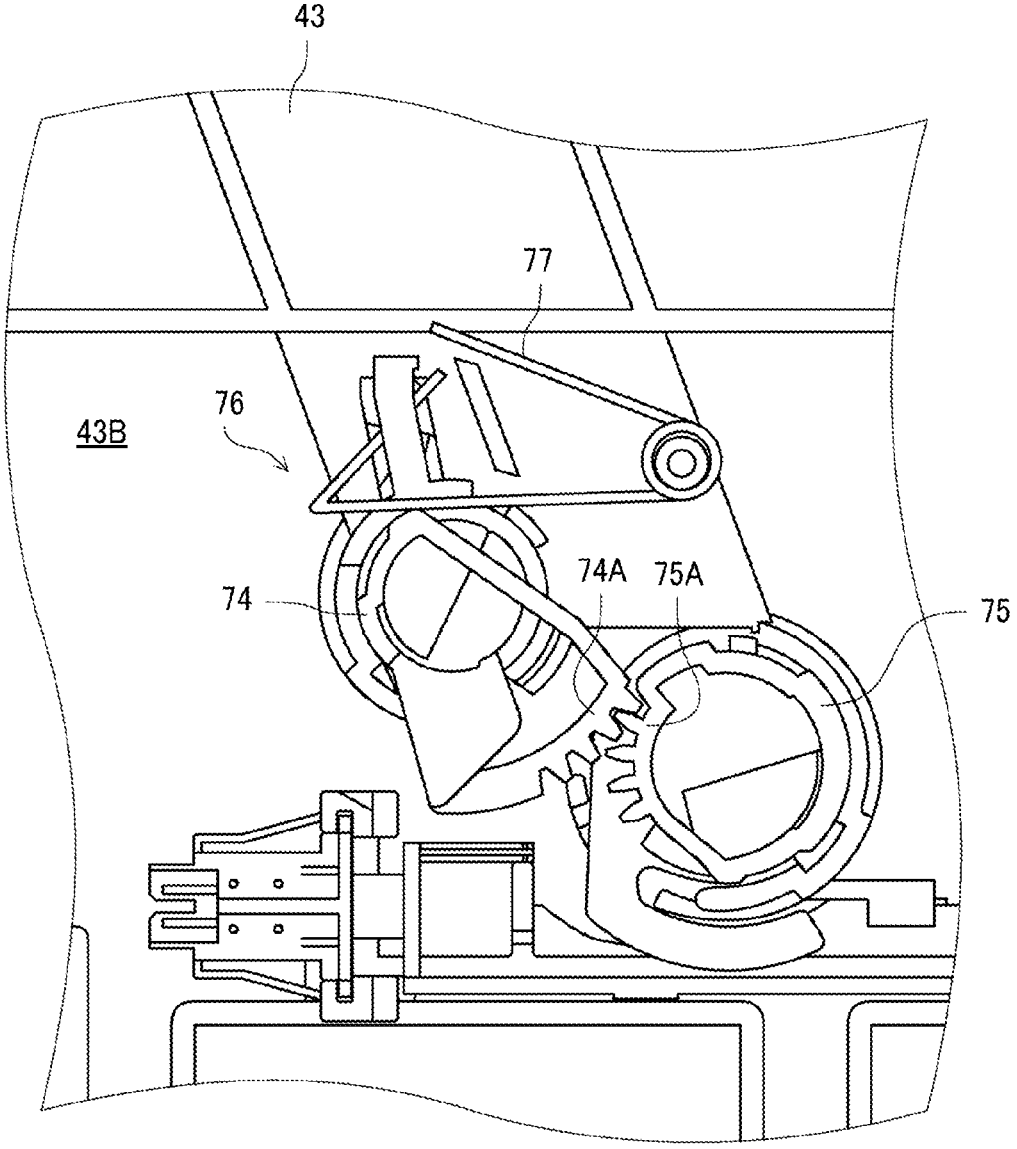
FIG. 15 is an expanded view of the driving transmission mechanism in the state where the lever has been swung.

Here, FIG. 11 shows the outer appearance of the support plate 43. FIGS. 12A through 15 show the driving transmission mechanism 76. It is noted that FIG. 11 shows the support plate 43 viewed from a left side surface 43A. FIGS. 12A and 12B are expanded views of the peripheral of one container guide 45 shown in FIG. 11. FIG. 13 shows the support plate 43 viewed from a right side surface 43B. FIG. 14 shows the state when the lever 67 is at the first operation position. FIG. 15 shows the state when the lever 67 is at the second operation position.

As shown in FIG. 13, the driving transmission mechanism 76 is provided on the right side surface 43B of the support plate 43. As shown in FIG. 11, the container guides 45 are provided on the left side surface 43A of the support plate 43. The lower part of each container guide 45 on the support plate 43 is branched into a first groove 45A and a second groove 45B. A projection 46 is formed between the first groove 45A and the second groove 45B, wherein the projection 46 extends along the first groove 45A and the second groove 45B.

The cover 72 is guided diagonally downward in the attachment direction by the container guide 45. During this guide process, the projection 46 is inserted into the guide groove 72E of the cover 72. Subsequently, the upper part of the projection 46 abuts on the releasing portion 71A of the lock member 71, and pushes up the lock member 71. In this way, when the toner container 50 is attached to the support plate 43, the lock member 71 abuts on the projection 46 and operates in the lock release direction. This allows the lock state of the operation portion 54 and the opening/closing mechanism 53 that have been locked by the lock member 71 to be released.

As shown in FIGS. 12 and 13, the attachment portion 40 is provided with the driving transmission mechanism 76. The driving transmission mechanism 76 is provided on the support plate 43 constituting the attachment portion 40. In the present embodiment, four driving transmission mechanisms 76 are provided in correspondence with the four toner containers 50. The driving transmission mechanisms 76 are provided on the right side surface 43B of the support plate 43 to be aligned in the front-rear direction 7.

When the lever 67 of the operation portion 54 is operated in the state where the toner container 50 is disposed to the attachment position on the support plate 43 and an operation driving force (driving force) is input, the driving transmission mechanism 76 is configured to transmit the driving force to the cylinder 61 of the opening/closing mechanism 53.

The driving transmission mechanism 76 includes a first rotation portion 74 as an input portion and a second rotation portion 75 as an output portion. The first rotation portion 74 is a portion that receives the operation driving force input from the operation portion 54 when the lever 67 of the operation portion 54 is operated. The second rotation portion 75 outputs (transmits), to outside (the cylinder 61 of the opening/closing mechanism 53), the operation driving force transmitted from the first rotation portion 74. The first rotation portion 74 is configured to rotate upon receiving the operation driving force. The second rotation portion 75 is configured to rotate in conjunction with the first rotation portion 74.

The first rotation portion 74 is disposed below the first groove 45A of the container guide 45, and is rotatably supported by the support plate 43. On the other hand, the second rotation portion 75 is disposed at the lower part of the second groove 45B, and is rotatably supported by the support plate 43.

As shown in FIGS. 14 and 15, the first rotation portion 74 includes a first gear 74A. The second rotation portion 75 includes a second gear 75A that meshes with the first gear 74A. The first gear 74A is integrally formed with the first rotation portion 74, and the second gear 75A is integrally formed with the second rotation portion 75. As a result, when the first rotation portion 74 rotates in the state where the first gear 74A and the second gear 75A mesh with each other, the second rotation portion 75 rotates reversely with respect to the rotational direction of the first rotation portion 74. As shown in FIG. 13, the first gear 74A and the second gear 75A are disposed on the right side surface 43B of the support plate 43, the right side surface 43B being opposite to the left side surface 43A on which the container guides 45 are formed.

As shown in FIG. 14, the support plate 43 is provided with a spring 77. The spring 77 biases the first rotation portion 74 counterclockwise in FIG. 14. The spring 77 is, for example, a torsion coil. The second rotation portion 75 is biased clockwise in FIG. 14 by the spring 77 via the first gear 74A and the second gear 75A.

As shown in FIGS. 9 and 10, the operation portion 54 of the toner container 50 includes a first coupling portion 78. The first coupling portion 78 is rotated when the operation portion 54 is operated. The first coupling portion 78 is integrally formed with the right end of the shaft 66. The first coupling portion 78 is formed on a plate rib that projects rightward from the right end of the shaft 66. The first coupling portion 78 extends in the attachment direction (namely, diagonally downward) in which the cover 72 is guided by the container guide 45 when the housing 51 is attached to the support plate 43. When the toner container 50 is attached to the container guide 45 of the support plate 43, the first coupling portion 78 is coupled with the first rotation portion 74 of the driving transmission mechanism 76. That is, the first coupling portion 78 is coupled with the first rotation portion 74 in the state where the toner container 50 is attached. This enables the operation driving force that is input with the operation of the operation portion 54 to be transmitted to the first rotation portion 74.

As shown in FIGS. 12A and 12B, a first coupling groove 74B is formed on the first rotation portion 74 of the driving transmission mechanism 76. The first coupling groove 74B is coupled with the first coupling portion 78 of the toner container 50. The first coupling groove 74B extends straight at least in part. On the other hand, the first coupling portion 78 has a shape to be fitted in the first coupling groove 74B. That is, the groove width of the first coupling groove 74B is approximately the same as the thickness of the first coupling portion 78. When the housing 51 is attached to the apparatus main body 28, the first coupling portion 78 is inserted into the first coupling groove 74B, and is coupled therewith so as to be integrally rotatable with the first rotation portion 74.

As shown in FIGS. 9 and 10, the cylinder 61 of the opening/closing mechanism 53 includes the second coupling portion 79 that integrally rotates with the cylinder 61. The second coupling portion 79 is integrally formed with the right end of the cylinder 61. The second coupling portion 79 projects rightward from the right end of the cylinder 61. The second coupling portion 79 is formed in a shape of a hook in a cross section that is perpendicular to the axis direction of the cylinder 61. The second coupling portion 79 receives the operation driving force from the second rotation portion 75 of the driving transmission mechanism 76. When the toner container 50 is attached to the container guide 45 of the support plate 43, the second coupling portion 79 is coupled with the second rotation portion 75 of the driving transmission mechanism 76. That is, the second coupling portion 79 is coupled with the second rotation portion 75 in the state where the toner container 50 has been disposed at the attachment position. This enables the operation driving force to be transmitted to the second coupling portion 79 via the first rotation portion 74 and the second rotation portion 75.

As shown in FIG. 18, the second coupling portion 79 includes a first portion 79A and a second portion 79B, these forming a shape of a hook. The first portion 79A extends in the attachment direction (namely, diagonally downward) in which the cover 72 is guided by the container guide 45 when the housing 51 is attached to the support plate 43. The second portion 79B extends in one of the rotational directions of the cylinder 61 from the upper end of the first portion 79A. The first portion 79A is larger in thickness than the first coupling portion 78.

As shown in FIGS. 12A and 12B, a second coupling groove 75B is formed on the second rotation portion 75 of the driving transmission mechanism 76. The second coupling groove 75B is coupled with the second coupling portion 79 of the toner container 50. The second coupling groove 75B extends straight at least in part. On the other hand, the second coupling portion 79 (see FIGS. 8 and 18) has a shape to be fitted in the second coupling groove 75B. That is, the groove width of the second coupling groove 75B is approximately the same as the thickness of the first portion 79A of the second coupling portion 79. As a result, the second coupling groove 75B is different from the first coupling groove 74B in groove width. When the housing 51 is attached to the support plate 43, the second coupling portion 79 is inserted into the second coupling groove 75B, and is coupled therewith so as to be integrally rotatable with the second rotation portion 75. The cylinder 61 of the opening/closing mechanism 53 is configured such that when the second coupling portion 79 integrally rotates with the second rotation portion 75, the cylinder 61 is rotated to open or close the toner discharge outlet 52.

The first coupling portion 78 and the second coupling portion 79 may be configured in a non-compatible shape which is a shape that allows for attachment of the housing 51 to the apparatus main body 28 of a predetermined model, while not allowing for attachment of the housing 51 to the apparatus main body 28 of the other models. For example, depending on the model or the like of the image forming apparatus 10, the first coupling portion 78, the second coupling portion 79, the first coupling groove 74B of the first rotation portion 74, and the second coupling groove 75B of the second rotation portion 75 are provided at different positions, in different shapes, or the like.

Figure 20:
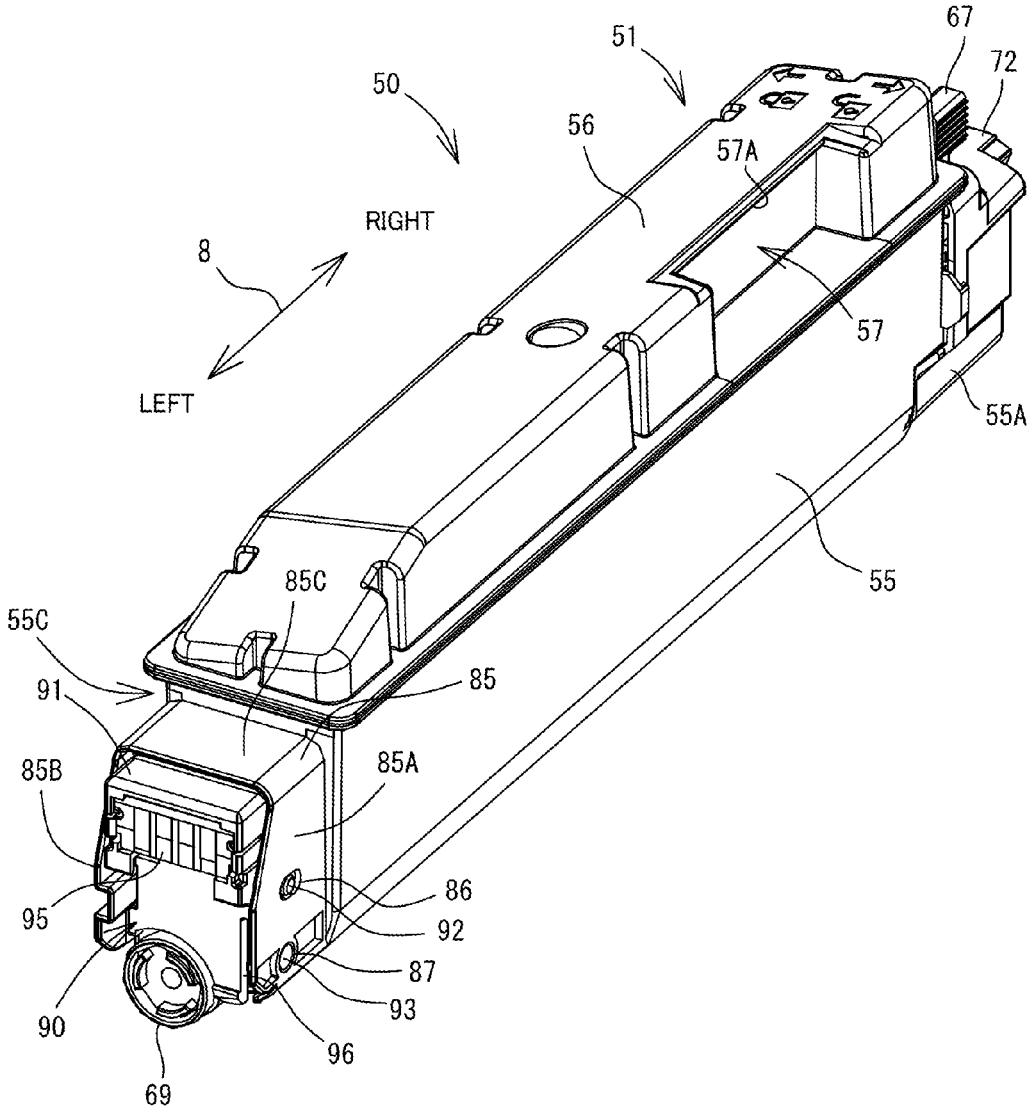
FIG. 20 is a diagram showing the toner container viewed from the left side.

As shown in FIGS. 3 and 20, the toner container 50 includes a memory holder 90 as a dislocation portion.

As shown in FIG. 20, memory holder 90 is attached to the side wall 55C that is on one side of the container main body 55 of the housing 51 in the longitudinal direction. Specifically, a protruding portion 85 is integrally formed with the side wall 55C, and the memory holder 90 is attached to the protruding portion 85.

The protruding portion 85 is formed in the shape of a curved rectangular plate, projecting more outside in the longitudinal direction than the side wall 55C. The protruding portion 85 includes side walls 85A and 85B that are positioned at opposite ends of the container main body in the short direction, and an upper wall 85C that connects the upper walls of the side walls 85A and 85B. The side walls 85A and 85B are parallel to each other, and the outer side surfaces are formed flat. The memory holder 90 is attached inside the protruding portion 85 that is surrounded by the upper wall 85C and side walls 85A and 85B. It is noted that the attachment configuration of the memory holder 90 is described below.

When the toner container 50 is attached to the attachment portion 40, the protruding portion 85 is inserted into a guide groove 100 (see FIG. 25) that is provided in the attachment portion 40, and guides the toner container 50 in the attachment/detachment direction of the toner container 50. At this time, the side walls 85A and 85B of the protruding portion 85 abut on the guide groove 100, and are guided in a guide direction (the same direction as the attachment/detachment direction of the toner container 50) by the guide groove 100. That is, the protruding portion 85 serves as a guide member that guides the toner container 50 in the attachment/detachment direction with respect to the attachment portion 40.

An elongated hole 86 that is elongated in the longitudinal direction is formed at approximately the center of each of the side walls 85A and 85B. The elongated hole 86 on the side wall 85B side is not shown in FIG. 20 because it is hidden by other member. The elongated hole 86 plays a role of guiding a guide shaft 92 provided in the memory holder 90 in the longitudinal direction such that the memory holder 90 is moved toward and away from the side wall 55C of the container main body 55, and plays a role of restricting the range in which the memory holder 90 is moved, wherein the guide shaft 92 is described below. In addition, a shaft hole 87 that becomes the pivoting fulcrum of the memory holder 90 is formed below the elongated hole 86 and near the lower end of each of the side walls 85A and 85B. The shaft hole 87 axially supports a pivoting shaft 93 provided in the memory holder 90 in a state where the pivoting shaft 93 is inserted therein, wherein the pivoting shaft 93 is described below.

Figure 21:
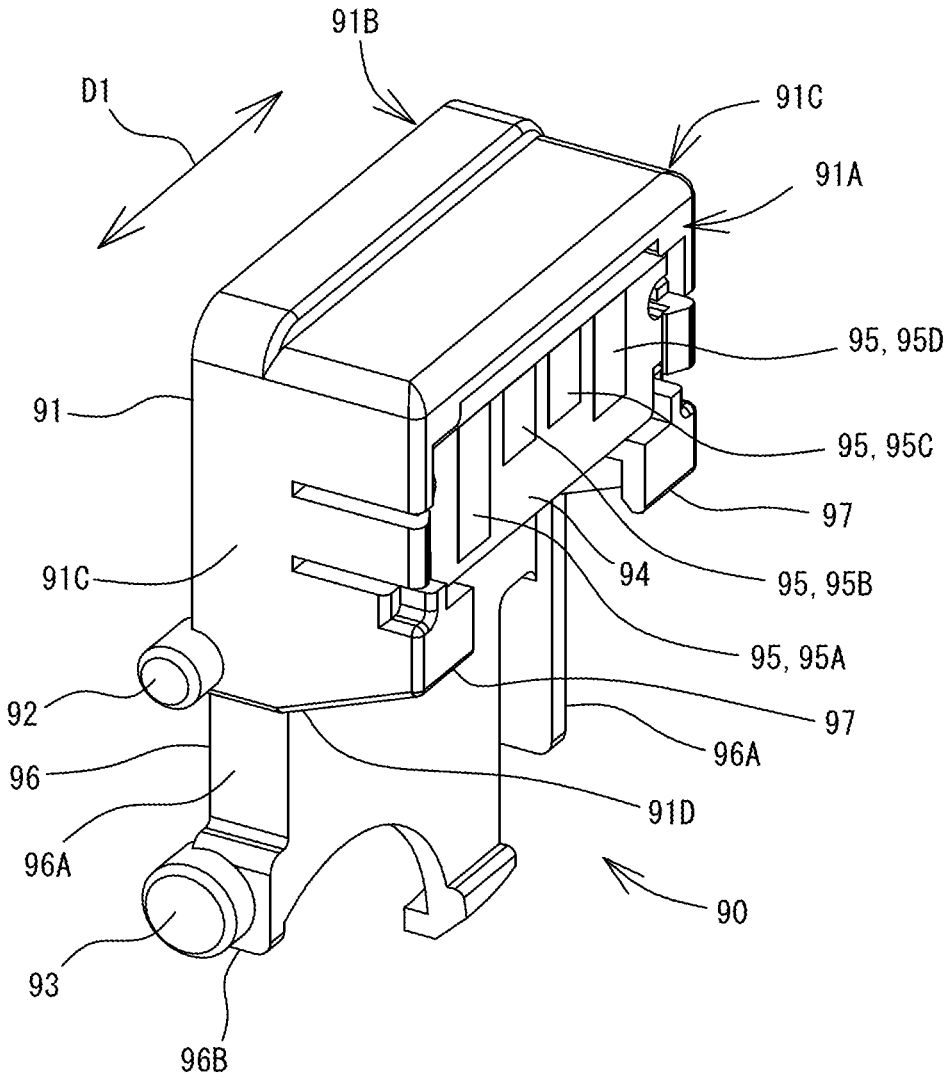
FIG. 21 is a diagram showing a memory holder provided in the toner container.
Figure 22C:
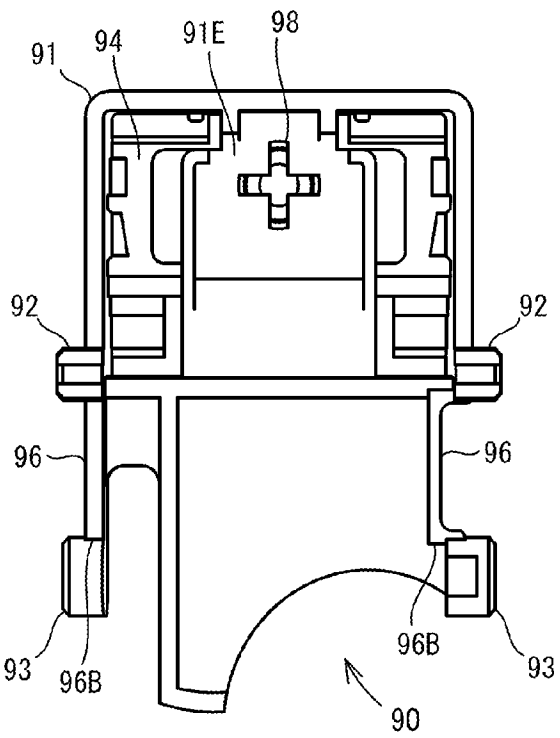
FIGS. 22A-22C are respectively a front view, a side view, and a rear view showing the configuration of the memory holder.
Figure 22B:
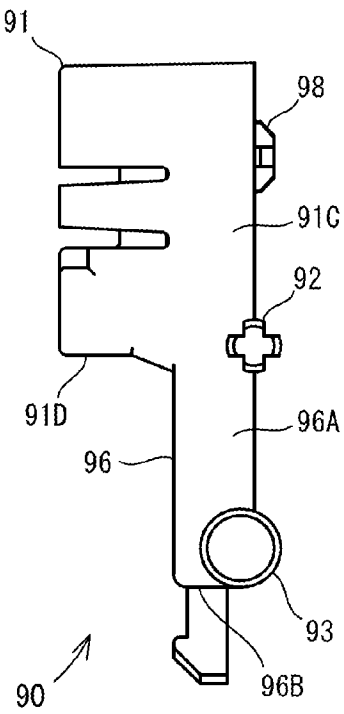
Figure 22A:
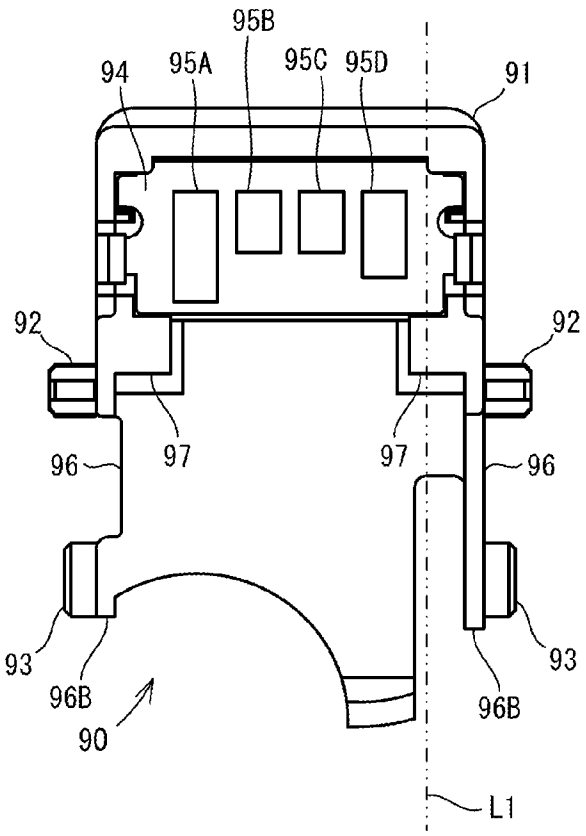

As shown in FIGS. 21 and 22, the memory holder 90 includes a holder main body 91, the guide shaft 92, and the pivoting shaft 93. The holder main body 91 is partially housed in the protruding portion 85. The guide shaft 92 is inserted into the elongated hole 86 of the protruding portion 85. The pivoting shaft 93 is pivotably supported by the shaft hole 87 of the protruding portion 85. The memory holder 90 is a synthetic resin product that is formed by the injection molding of synthetic resin. As a result, the holder main body 91, guide shaft 92, and pivoting shaft 93 are integrally formed.

The holder main body 91 has a shape of a rectangular parallelepiped whose inside is hollow. The holder main body 91 is disposed inside the protruding portion 85, and the whole area of its rear surface 91B is opened. The holder main body 91 also has a front surface 91A (a holding surface). Connection terminals 95 (95A through 95D) as the first contact portion are provided on the front surface 91A. The front surface 91A is a surface that is to face a side wall 100B (see FIG. 25A) of an attachment portion 47 that is described below. The connection terminals 95 are connection terminals of a storage portion (not shown) such as a chip memory or a flash memory. The four connection terminals 95 are provided on a board 94 that is exposed to the front surface 91A of the holder main body 91. These four connection terminals 95 are electrically conducted with a conductive material when they contact the conductive material. The four connection terminals 95 are disposed in an alignment in the width direction (direction indicated by the arrow D1) on the board 94. The four connection terminals 95 are, for example, electrodes made from copper foil. The connection terminal 95A is a ground electrode, the connection terminals 95B and 95C are signal electrodes, and the connection terminal 95D is a power source electrode. In the present embodiment, the electrode length of each of the connection terminals 95 is determined such that, when the toner container 50 is attached to the attachment portion 40, the connection terminal 95A first contacts a connection terminal 103 (see FIG. 23) provided in the attachment portion 40, then the connection terminal 95D, and finally the connection terminals 95B and 95C, wherein the connection terminal 103 is described below.

The storage portion stores information related to the toner stored in the toner container 50. The information related to the toner includes, for example, the amount of toner stored in an unused toner container 50, the remaining amount of toner, a time when the toner was stored, a condition to which the stored toner is applicable. It is noted that the storage portion is fixed to the rear side of the holder main body 91 or the side wall 55C, and is connected to the connection terminals 95 via a wire harness including a signal line and a power source line.

The guide shaft 92 is provided on both side surfaces 91C of the holder main body 91 in the width direction. The guide shaft 92 is provided near a lower end 91D of the holder main body 91. The guide shaft 92 is provided at a position of the lower end 91D on the rear surface 91B side. The guide shaft 92 is a shaft having a shape of a cross in cross section, and projects outside from the side surfaces 91C. The guide shaft 92 is inserted into the elongated hole 86 of the protruding portion 85. It is noted that the length of the projected part of the guide shaft 92 is determined such that the guide shaft 92 inserted in the elongated hole 86 does not project outside the outer side surfaces of the side walls 85A and 85B of the protruding portion 85.

The memory holder 90 includes an arm 96 that extends downward from the lower end 91D of the holder main body 91. The pivoting shaft 93 is provided on both side surfaces 96A of the arm 96 in the width direction. The pivoting shaft 93 is provided near a lower end 96B of the arm 96. The pivoting shaft 93 has a shape of a circle in cross section, and projects outside from each of the side surfaces 96A. The pivoting shaft 93 is inserted into the shaft hole 87 of the protruding portion 85. It is noted that the length of the projected part of the pivoting shaft 93 is determined such that the pivoting shaft 93 axially supported by the pivoting shaft 93 does not project outside the outer side surfaces of the side walls 85A and 85B of the protruding portion 85.

As shown in FIG. 22C, on the rear side of the memory holder 90, a bracket 91E as the bracket portion and a spring supporting portion 98 are provided. The bracket 91E is provided at the upper end of the rear side of the memory holder 90, namely, the bracket 91E is provided at the upper end of the holder main body 91. The spring supporting portion 98 is provided on the bracket 91E that is provided on the rear side of the holder main body 91. The bracket 91E is integrally formed with the holder main body 91, and disposed between the connection terminals 95 and the side wall 55C. The bracket 91E is provided at a position that is located away from the board 94 toward the side wall 55C by a predetermined distance. The spring supporting portion 98 has a shape of projection projecting from the center of the bracket 91E in the width direction.

Figure 23:
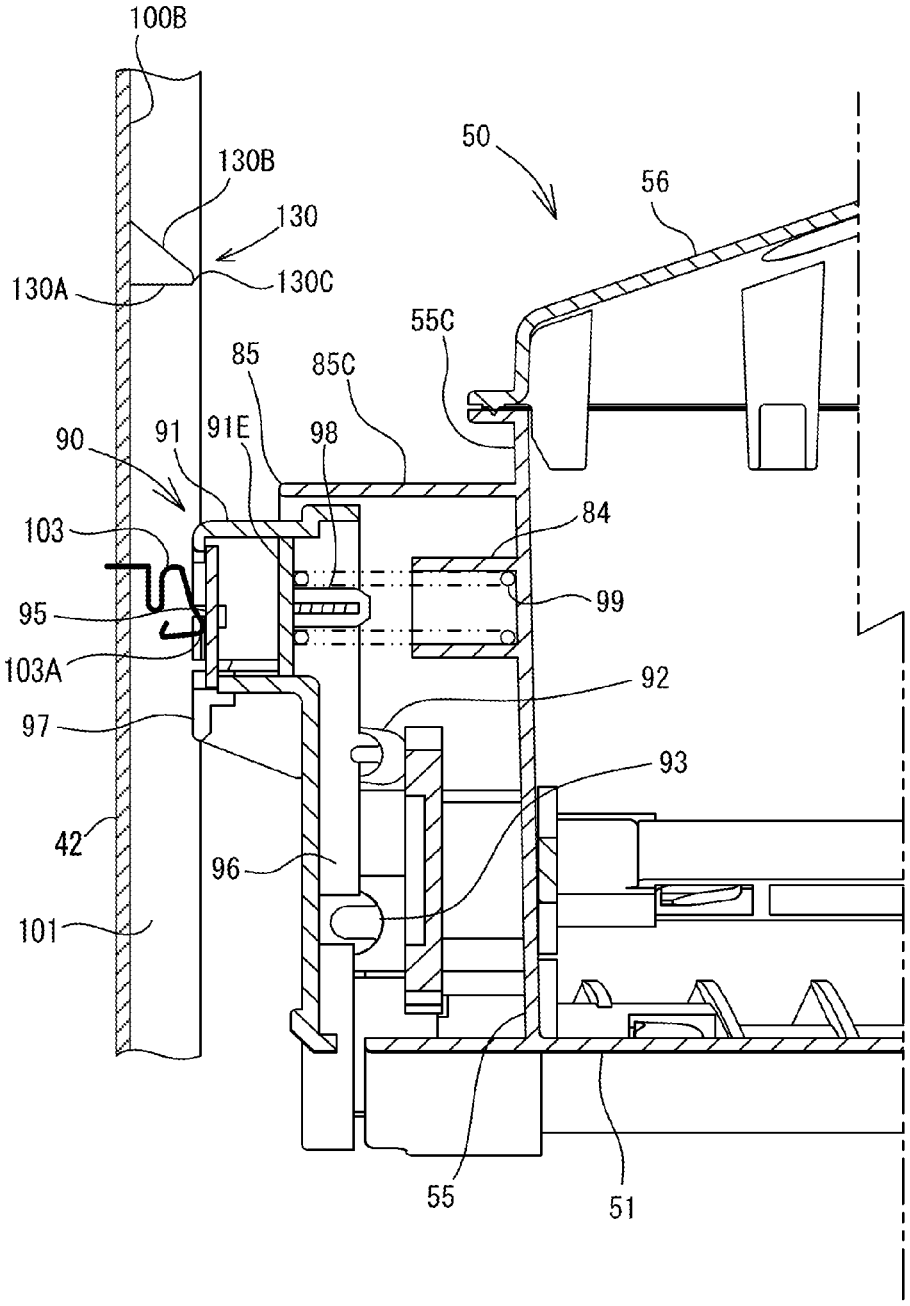
FIG. 23 is a diagram showing the cross-sectional configuration of the memory holder.

As shown in FIG. 23, a spring receiving portion 84 is provided on the protruding portion 85. The spring receiving portion 84 is a cylindrical member erecting on the side wall 55C. The spring receiving portion 84 is provided at a position to face the spring supporting portion 98 of the memory holder 90.

As shown in FIG. 23, a compression spring 99 as an elastic member is provided between the memory holder 90 and the protruding portion 85. The compression spring 99 is, for example, a coil spring. The spring supporting portion 98 supports an end of the compression spring 99 that is located between the memory holder 90 and the protruding portion 85. Specifically, the spring supporting portion 98 supports the compression spring 99 in the state where the inner hole of an end of the compression spring 99 that is a coil spring is inserted into the spring supporting portion 98. In addition, the spring receiving portion 84 supports the other end of the compression spring 99. Specifically, the spring receiving portion 84 supports the compression spring 99 in the state where the other end of the compression spring 99 is inserted into the spring receiving portion 84. In the present embodiment, the compression spring 99 in the compressed state is attached between the spring supporting portion 98 and the spring receiving portion 84. With this configuration, in the state where the memory holder 90 is attached to the protruding portion 85, the compression spring 99 always presses outside the upper end side of the memory holder 90 that is opposite to the pivoting shaft 93 side of the memory holder 90.

With the above-described configuration of the memory holder 90, it is possible to attach the memory holder 90 to the protruding portion 85 by causing the shaft hole 87 to support the pivoting shaft 93 and inserting the guide shaft 92 into the elongated hole 86. Specifically, the memory holder 90 is pivotably supported by the protruding portion 85 to pivot around the pivoting shaft 93.

Figure 24C:
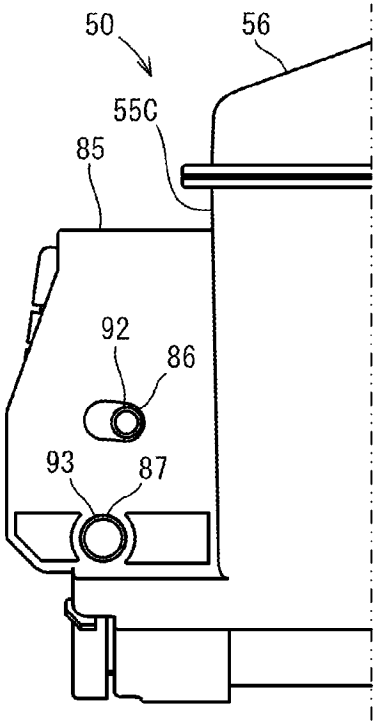
FIGS. 24A-24C are diagrams showing the operation of the memory holder.
Figure 24B:
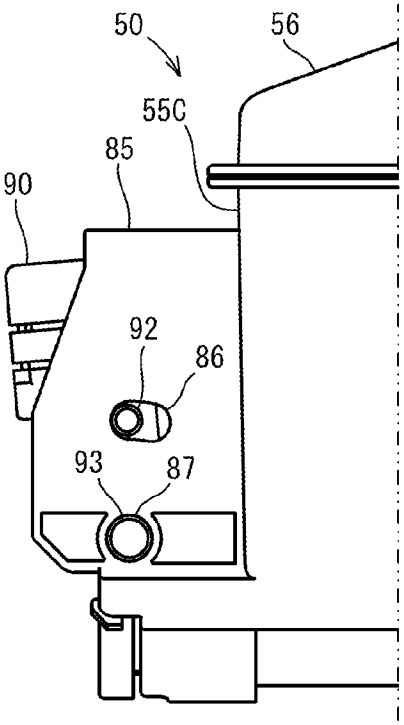
Figure 24A:
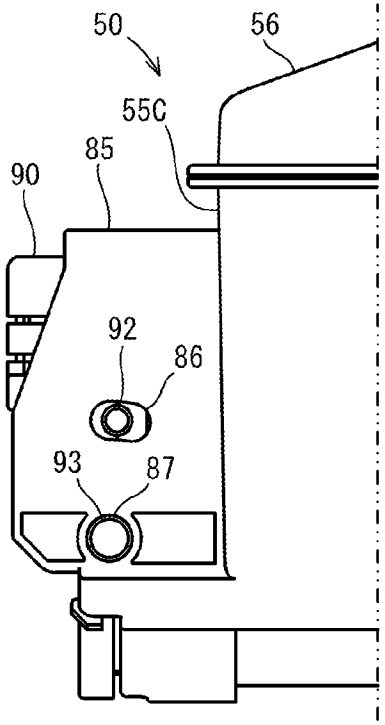

The pivoting range of the memory holder 90 with respect to the protruding portion 85 is determined by setting the length of the elongated hole 86 appropriately. In the present embodiment, the memory holder 90 is pivotably supported by the protruding portion 85 to pivot around the pivoting shaft 93 between a first attitude (the attitude shown in FIG. 24C) and a second attitude (the attitude shown in FIG. 24B). Here, at the first attitude, the rear surface 91B side of the holder main body 91 partially enters inside the protruding portion 85 and is closest to the side wall 55C (see FIG. 24C). At the second attitude, the holder main body 91 is pulled from the protruding portion 85 at maximum and is at the largest distance from the side wall 55C (see FIG. 24B). The memory holder 90 is pivotably supported as described above. As a result, the memory holder 90 can be dislocated toward and away from the side wall 55C. That is, the memory holder 90 is supported by the protruding portion 85 in such a manner that the memory holder 90 can be moved toward and away from the side wall 55C.

Furthermore, the compression spring 99 is provided between the memory holder 90 and the protruding portion 85. As a result, in the state where no external force is applied to the memory holder 90, the memory holder 90 maintains the second attitude. When the memory holder 90 receives a pressing force from the attachment portion 47 described below when, for example, the toner container 50 is attached to the attachment portion 40, the compression spring 99 is compressed and the memory holder 90 is rotationally operated, changing the attitude from the second attitude to the first attitude.

It is noted that the memory holder 90 includes two engagement pieces 97. Specifically, as shown in FIG. 21, the engagement pieces 97 are provided on the front surface 91A side of the lower end 91D of the holder main body 91. That is, the engagement pieces 97 are provided at the lower end of the front surface 91A of the holder main body 91. The engagement pieces 97 are repectively provided at both ends of the lower end of the front surface 91A in the width direction. The engagement pieces 97 are each formed in the shape of a claw that extends downward from the lower end 91D of the holder main body 91. The engagement pieces 97 are engaged with a cover 107 that is described below, and move the cover 107.

Meanwhile, the positional relationship between the toner discharge outlet 52 and a toner receiving inlet (not shown) of the developing device 12 is important for the toner container 50, and if the toner discharge outlet 52 and the toner receiving inlet are positionally shifted from each other, a toner leakage or the like occurs. For this reason, in the state where the toner container 50 is attached to the attachment portion 40, the toner discharge outlet 52 and the toner receiving inlet are positioned with a high accuracy. On the other hand, at an end on the side wall 55C side opposite to the side wall 55B, the size tolerance of the housing 51, the memory holder 90 and the like of the toner container 50 is accumulated, and therefore the end on the side wall 55C side may not necessarily be positioned to a constant position in the left-right direction 8 (the longitudinal direction of the toner container 50) of the image forming apparatus 10. In that case, a contact failure may occur because the connection terminals 95 may fail to contact the connection terminal 103 (see FIG. 25A) of the attachment portion 40 due to the positional shift on the side wall 55C side due to the size tolerance, or if it contacts, may have an insufficient contact pressure. On the other hand, according to the present embodiment, in each of the toner containers 50, the memory holder 90 is pressed outside by the compression spring 99, thereby making it difficult for a contact failure to occur to the connection terminals 95.

As shown in FIG. 2, the support plate 42 as a support wall is erected at the left end of the attachment portion 40. The support plate 42 is configured to support the memory holders 90 that are at an end of the four toner containers 50. The support plate 42 extends in the front-rear direction 7 and faces the side walls 55C of the four toner containers 50. The support plate 42 supports ends of the toner containers 50 on the side wall 55C side. More specifically, the support plate 42 supports the memory holders 90. The memory holders 90 are supported by the attachment portion 47 provided on the support plate 42.

Figure 25B:
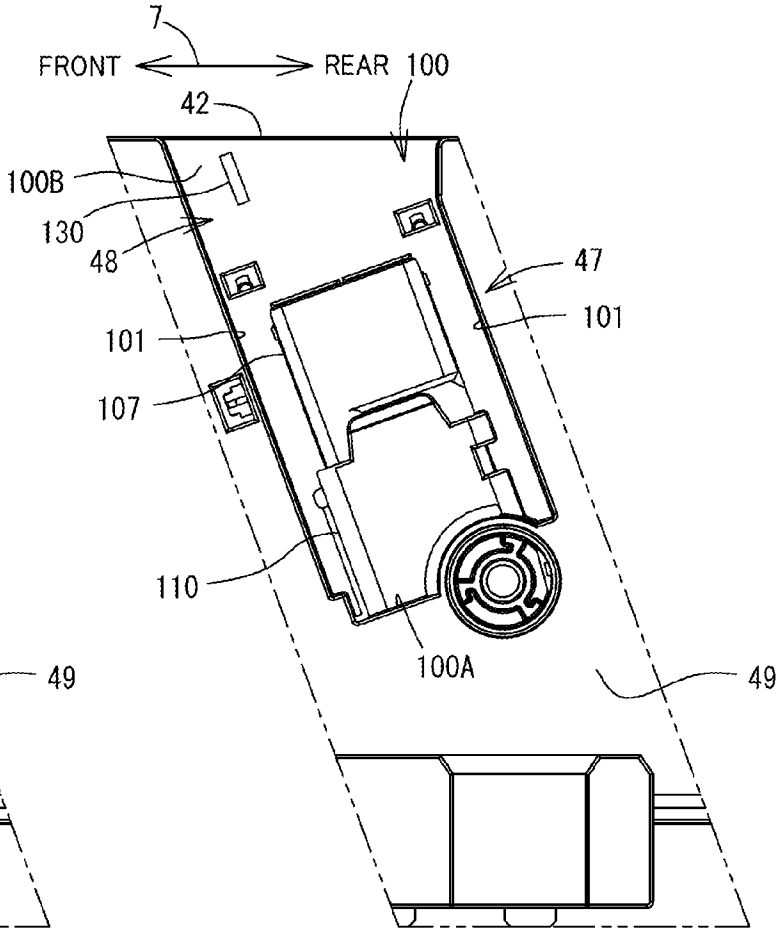
FIGS. 25A and 25B are diagrams showing the configuration of an attachment portion of the memory holder.
Figure 25A:
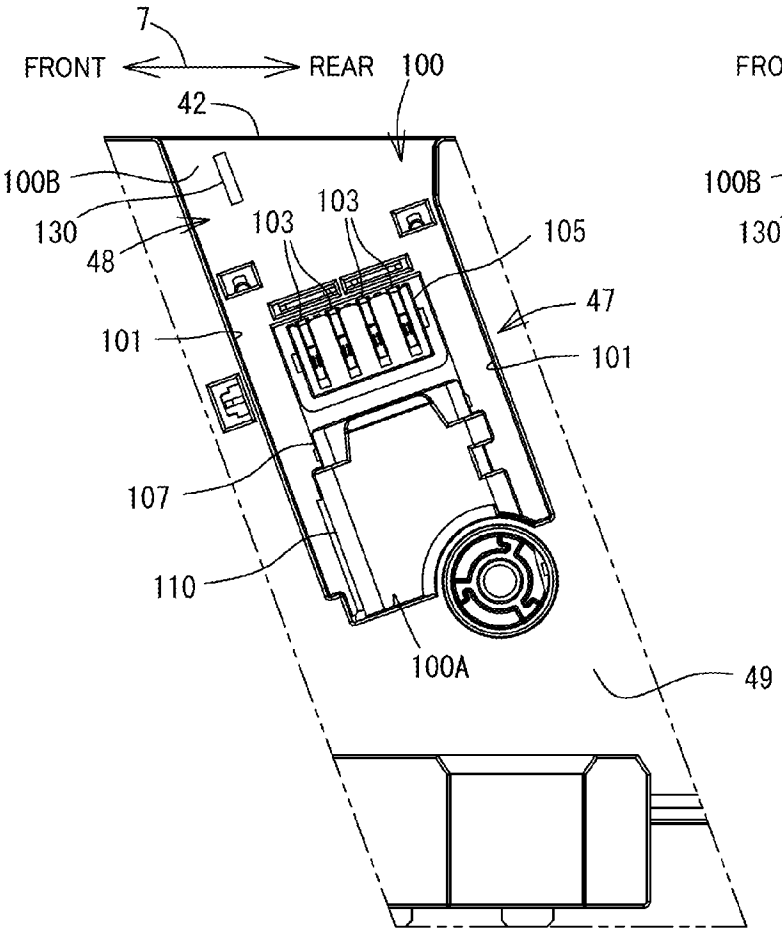

As shown in FIGS. 25A and 25B, the attachment portion 47 includes the guide groove 100. The guide groove 100 includes a pair of guide surfaces 101 on both sides in the front-rear direction 7. The guide surfaces 101 of the guide groove 100 extend diagonally upward from a lower end 100A of the guide groove 100, and are flat surfaces that are parallel to each other. A part between the guide surfaces 101 is a recessed part 48 where an inner side surface 49 of the support plate 42 is recessed in the thickness direction, and a front inner surface and a rear inner surface of the recessed part 48 are the guide surfaces 101. In other words, the guide groove 100 is formed on the inner side surface 49 when the recessed part 48 whose upper part is opened is formed on the inner side surface 49 of the support plate 42.

As shown in FIG. 25A, the attachment portion 47 includes four connection terminals 103 as the second contact portion. The four connection terminals 103 are provided on the side wall 100B of the guide groove 100 that is parallel to the support plate 42. The side wall 100B is a facing surface that faces the memory holder 90 in the state where the toner container 50 is attached at the attachment position of the attachment portion 40. The four connection terminals 103 contact and are connected respectively with the four connection terminals 95 provided in the toner containers 50 such that they are electrically conductive with each other. The four connection terminals 103 respectively correspond to the four connection terminals 95, and are disposed at positions to face the connection terminals 95 in the state where the toner containers 50 have been attached to the attachment portion 40. Each of the connection terminals 103 is formed by bending and deforming a conductive metal wire or a conductive elongated plate member with a narrow width. With such a configuration, the connection terminals 103 have springness. That is, the connection terminals 103 are formed in a shape which allows them to be elastically deformed upon receiving a pressing force. An end of each connection terminal 103 is fixed to a board 105 that is attached to the side wall 100B. The other end of each connection terminal 103 includes a contact part 103A (see FIG. 23) that is projecting from the board 105 and formed in a bent shape. The contact part 103A is contacted with the connection terminal 95. It is noted that a wire harness is connected to the board 105, and an end of the fixed side of the connection terminal 103 is electrically connected with the wire harness.

The cover 107 for covering the four connection terminals 103 is provided on the side wall 100B of the guide groove 100. When the toner container 50 is attached to the attachment portion 40, following the attachment operation, the cover 107 is engaged with the toner container 50, allowing the connection terminal 95 of the toner container 50 to be moved to a predetermined set position. The set position is a position where the connection terminal 95 of the toner container 50 can contact the connection terminal 103 of the attachment portion 40. Specifically, the set position is a position where the connection terminals 103 are bent toward the board 105 side after abutting on the connection terminals 95 and further being pressed by the connection terminals 95.

The cover 107 is slidably supported by the side wall 100B. The cover 107 is movable between a covering position (the position shown in FIG. 25B) covering the connection terminals 103 and an exposing position (the position shown in FIG. 25A) exposing the connection terminals 103. As the slide support mechanism of the cover 107, a known rail support mechanism using rails and rail guides may be adopted. With the configuration where the cover 107 is provided, when the toner container 50 has not been attached, the cover 107 can be moved to the covering position such that the connection terminals 103 are protected by the cover 107. It is noted that the user manually moves the cover 107 to the covering position after detaching the toner container 50. Of course, an elastic member such as a spring that biases the cover 107 toward the covering position may be provided such that, when the toner container 50 is detached, the cover 107 is automatically moved from the exposing position to the covering position by the spring force that is restricted until the toner container 50 is detached. In that case, when the toner container 50 is attached to the attachment portion 40, following the attachment operation, the cover 107 resists the spring force and is moved from the exposing position to the covering position.

The guide groove 100 includes a storing portion 110 configured to store the cover 107 when the cover 107 is at the exposing position. The storing portion 110 is fixed to the side wall 100B. The storing portion 110 is located farther away from the side wall 100B than the cover 107. When the cover 107 moves to the exposing position, the cover 107 is stored in a storing space formed between the side wall 100B and the storing portion 110. Inside the storing portion 110, a stopper (not shown) is formed to restrict the movement of the cover 107. When the cover 107 is pulled down to the exposing position, the lower end of the cover 107 abuts on the stopper and is restricted from moving downward from the position.

As shown in FIGS. 23 and 25A, a triangular rib 130 is provided as a projection on the side wall 100B of the guide groove 100. The triangular rib 130 is formed to be triangular when viewed from the side. The triangular rib 130 is a rib-like member with a narrow width extending in the extension direction (the same direction as the attachment/detachment direction of the toner container 50 with respect to the attachment portion 40) of the guide groove 100, and is integrally formed with the support plate 42. In the present embodiment, the triangular rib 130 is attached to a region that does not contact the connection terminals 95 on the front surface 91A of the memory holder 90 during the process in which the toner container 50 is attached to the attachment portion 40. Specifically, the triangular rib 130 is provided at a position so that it sliding contacts a region that passes through a virtual line L1 shown in FIG. 22A and reaches an end of the board 94, more specifically an end of the surface of the board 94 that is between the connection terminal 95D and the edge in the width direction. That is, the triangular rib 130 is provided at a position so that it sliding contacts a region excluding the four connection terminals 95.

As shown in FIG. 23, the bottom of the triangular rib 130 is a horizontal surface 130A. In addition, an inclined surface 130B (upper inclined part) is formed on the upper part of the triangular rib 130, wherein the inclined surface 130B extends diagonally upward from a top portion 130C. The inclined surface 130B is a plane extending straight from the top portion 130C to the side wall 100B. In the process where the toner container 50 is attached to the attachment portion 40, the inclined surface 130B plays a role of pushing back the memory holder 90 toward the protruding portion 85 side. In addition, in the process where the toner container 50 is attached, the horizontal surface 130A plays a role of being engaged with the holder main body 91 of the memory holder 90 after the memory holder 90 passes the triangular rib 130 so that the toner container 50 cannot be removed easily. The inclination angle of the inclined surface 130B and the projection length of the triangular rib 130 are determined based on elements such as the movable range of the memory holder 90, the distance between the memory holder 90 and the side wall 100B, and the attachment position of the triangular rib 130 in the height direction.

The following describes the attachment/detachment operation of the toner container 50 to the attachment portion 40.

Before the toner container 50 is attached to the attachment portion 40 of the apparatus main body 28, the toner discharge outlet 52 is closed by the cylinder 61, and the operation portion 54 and the opening/closing mechanism 53 are in the lock state by the lock member 71. At this time, as shown in FIG. 10A, the first coupling portion 78 and the second coupling portion 79 respectively extend in the attachment direction (namely, diagonally downward) in which the cover 72 is guided by the container guide 45. In addition, the lever 67 is at the first operation position, and the cylinder 61 is at the closing position.

Furthermore, before the toner container 50 is attached to the attachment portion 40, as shown in FIG. 12A, in the driving transmission mechanism 76, the first coupling groove 74B of the first rotation portion 74 and the second coupling groove 75B of the second rotation portion 75 are extending in the extension direction of the container guide 45 (namely, the attachment direction in which the cover 72 is guided).

When the toner container 50 is attached to the attachment portion 40, the cover 72 is inserted into the container guides 45 of the support plate 43, and the memory holder 90 is inserted into the guide groove 100 of the attachment portion 47 on the support plate 42.

On the container guide 45, the cover 72 is guided diagonally downward by the container guide 45. The first coupling portion 78 of the toner container 50 is guided by the first groove 45A, while the second coupling portion 79 is guided by the second groove 45B. Subsequently, the first coupling portion 78 is coupled with the first coupling groove 74*b* of the first rotation portion 74, and the second coupling portion 79 is coupled with the second coupling groove 75*b* of the second rotation portion 75.

In addition, while the cover 72 is guided by the container guides 45, the upper end of the projection 46 abuts on the releasing portion 71A of the lock member 71 and pushes up the lock member 71. With this operation, in the state where the first coupling portion 78 is coupled with the first rotation portion 74 and the second coupling portion 79 is coupled with the second rotation portion 75, the operation portion 54 and the opening/closing mechanism 53 of the toner container 50 are released from the lock state.

Figure 26C:
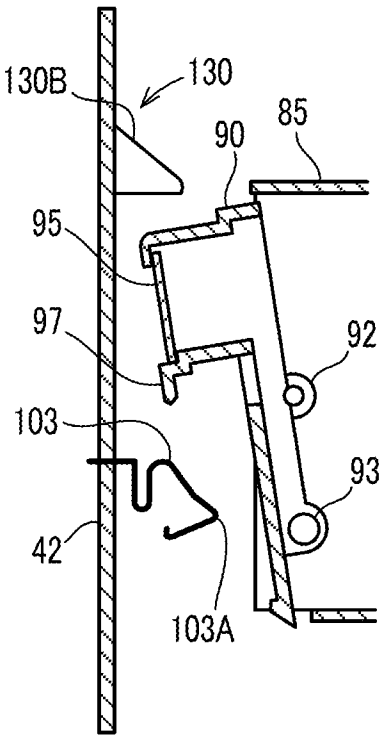
FIGS. 26A-26C are diagrams showing the operation of the memory holder when the toner container passes the projection.
Figure 26B:
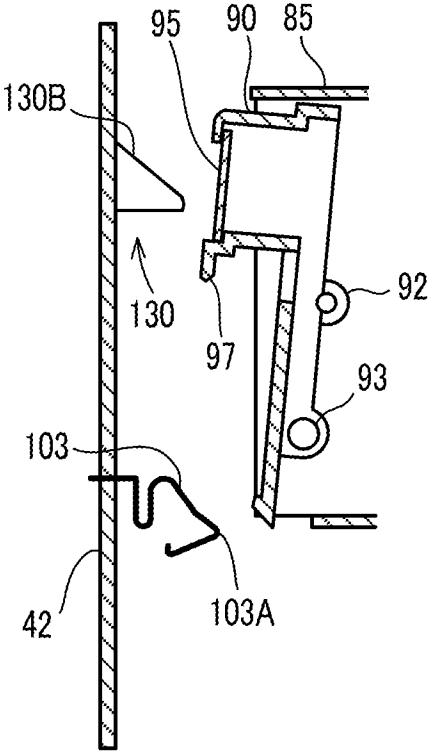
Figure 26A:
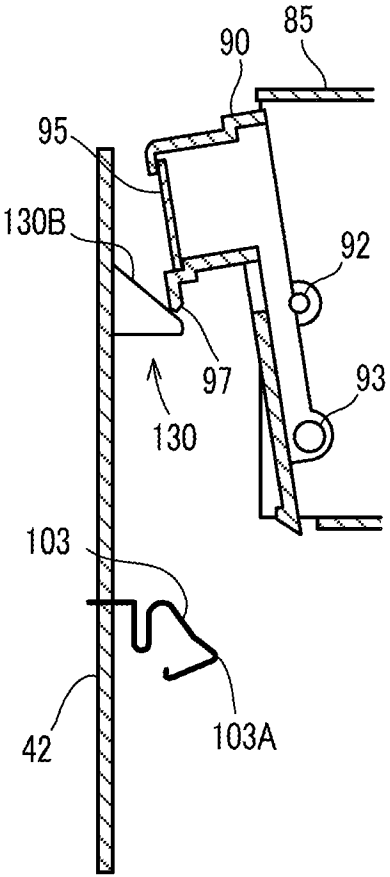

On the other hand, in the attachment portion 47, when the memory holder 90 is inserted into the guide groove 100, the engagement piece 97 contacts the inclined surface 130B of the triangular rib 130 (see FIG. 26A). At this time, the inclined surface 130B applies a force to press the memory holder 90 against the side wall 55C. Upon receiving the force, the memory holder 90 enters inside the protruding portion 85 (see FIG. 26B). After this, when the memory holder 90 is further inserted and the upper end of the memory holder 90 passes the triangular rib 130, the memory holder 90 is biased by the compression spring 99 and returns to the attitude of projecting from the protruding portion 85 (see FIG. 26C).

When the memory holder 90 is further inserted, the engagement piece 97 abuts on and is engaged with an upper end 77A of the cover 107. As described above, at this time, the cover 107 has been positioned at the covering position. As a result, receiving a downward force, the cover 107 is moved to the exposing position. Subsequently, when the cover 107 is moved to the exposing position, its lower end is supported by the stopper (not shown).

Figure 27C:
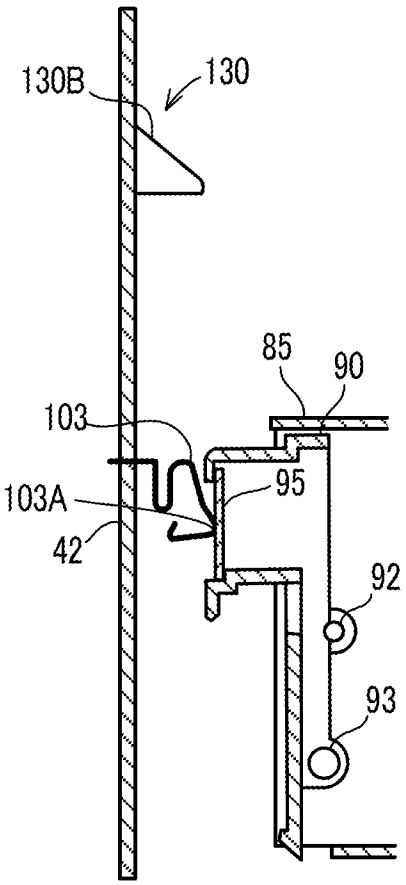
FIGS. 27A-27C are diagrams showing the operation of the memory holder when the toner container is attached to the attachment position.
Figure 27B:
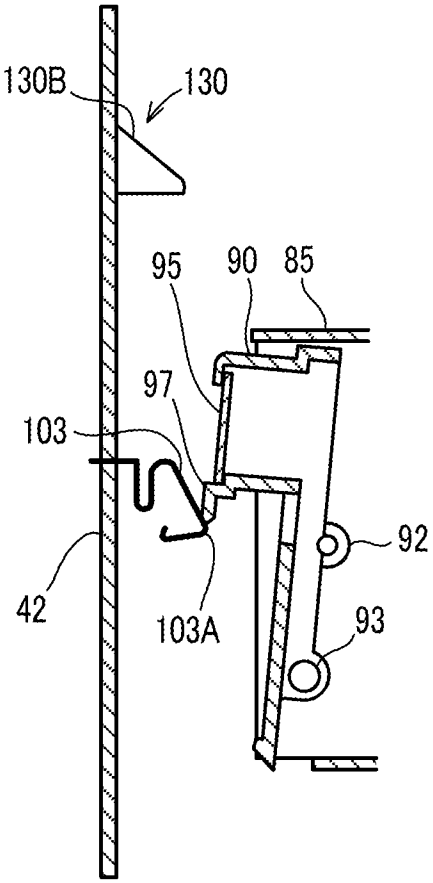
Figure 27A:
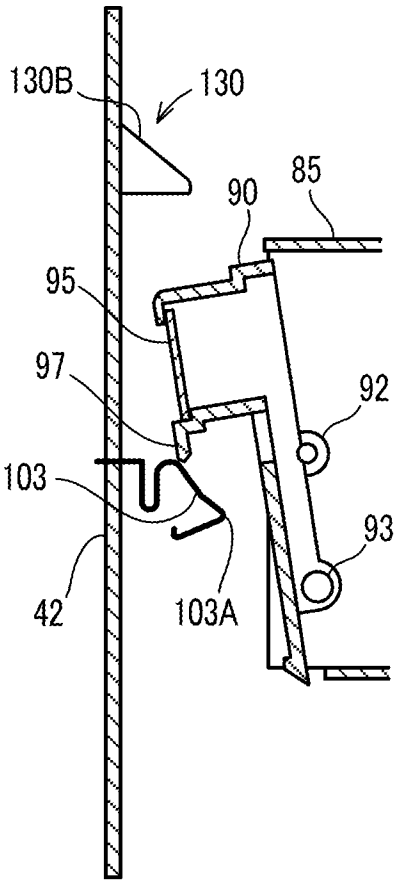

When the toner container 50 is further inserted in the attachment direction in the state where the cover 107 is at the exposing position, the engagement piece 97 abuts on the contact part 103A of the connection terminal 103 (see FIG. 27A), and then starts pressing the connection terminals 103 (see FIG. 27B). Subsequently, with a further insertion, the connection terminals 95 come to be in contact with the connection terminals 103 (see FIG. 27C). At this time, since the connection terminals 103 apply a force to press the memory holder 90 against the side wall 55C, the connection terminals 103 are contacted with the connection terminals 95 in a reliable manner without a contact failure.

Figure 28:
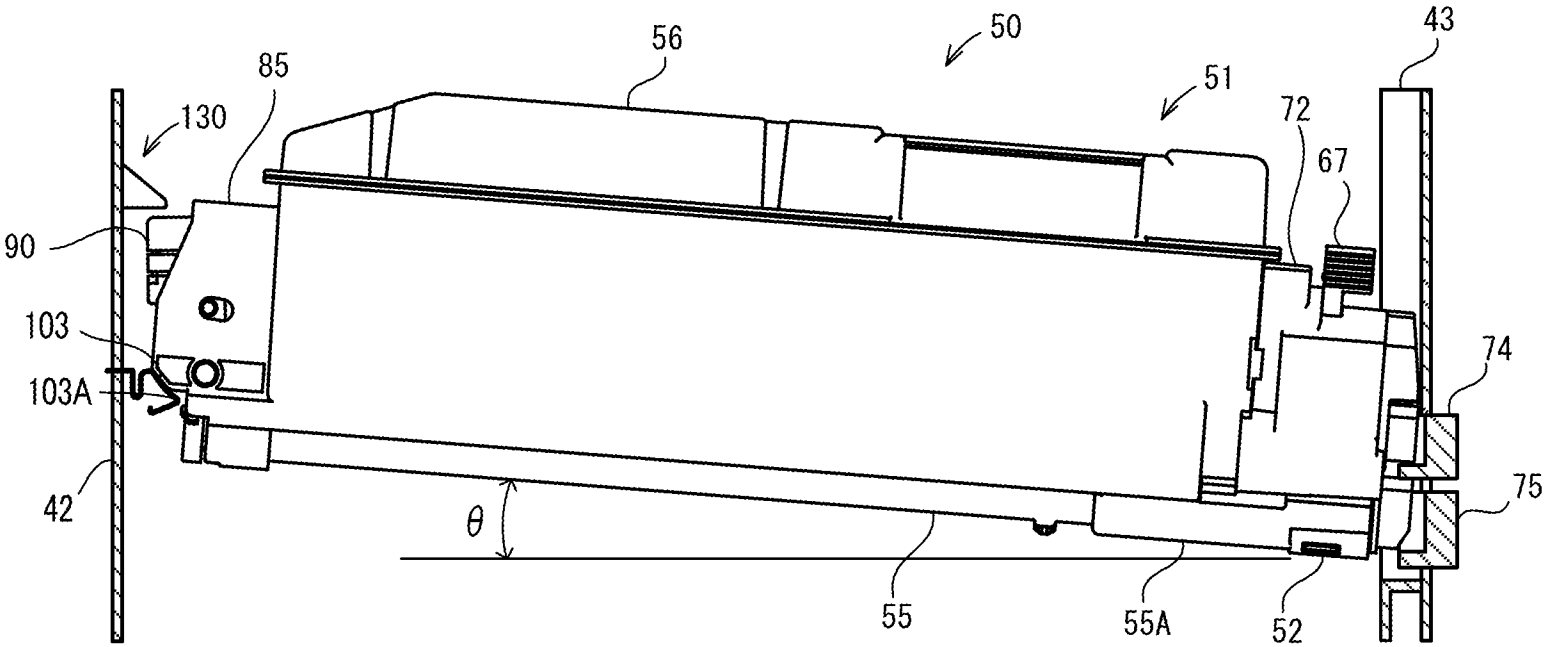
FIG. 28 is a diagram showing the state where the toner container is attached, in an inclined state, to the attachment portion.

Here, the following problems may occur if the toner container 50 is not attached to the attachment portion 40 in a complete manner. For example, as shown in FIG. 28, the toner container 50 may be attached to the attachment portion 40 in a state where the toner container 50 is inclined with respect to the attachment portion 40 by an angle θ. Specifically, in FIG. 28, the cover 72 is disposed at a position corresponding to the attachment position. In addition, the memory holder 90 is not disposed at a position corresponding to the attachment position, but is disposed at a position located upper than the corresponding position. It is noted here that the position of the cover 72 corresponding to the attachment position is a position at which the cover 72 is disposed when the toner container 50 is attached to the attachment position of the attachment portion 40. If the lever 67 is rotationally operated to supply toner from the toner discharge outlet 52 in such an incomplete state where the toner container 50 is inclined with respect to the attachment portion 40 by the angle θ, the driving force is not transmitted to the screw portion 58. In that case, a toner shortage occurs, resulting in a printing failure. At this time, when the user opens the top cover 33 and removes the toner container 50, toner drops down from the container since the toner discharge outlet 52 has been opened, and soils the surroundings. In addition, if the toner discharge outlet 52 is closed by operating the lever 67 in the state where the toner container 50 has been removed, it becomes impossible to attach the toner container 50 again because the driving transmission mechanism 76 has not been returned to the original position. However, as described above, the triangular rib 130 is provided in the present embodiment. With this configuration, if an attempt is made to remove the toner container 50, the toner container 50 cannot be removed easily because the triangular rib 130 is hooked. This makes the user hesitant to remove it. At this time, when the user finds an incomplete attachment state of the toner container 50, the user can attach the toner container 50 in a complete manner by pushing the toner container 50 in the attachment direction.

Figure 29:
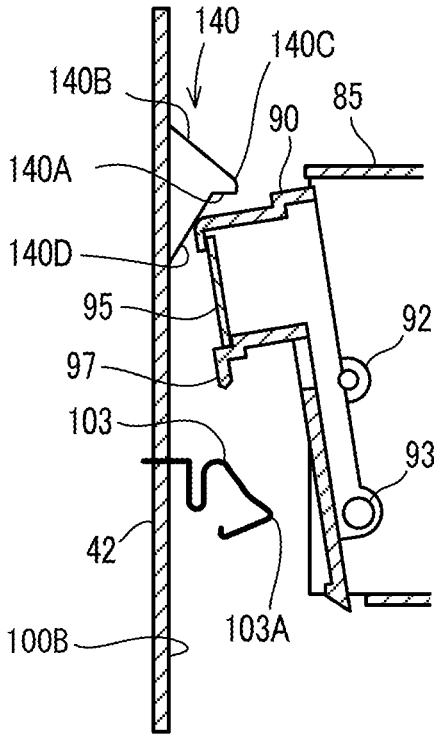
FIG. 29 is a diagram showing a modification of the projection.

It is noted that a triangular rib 140 shown in FIG. 29 may be applied instead of the triangular rib 130. The triangular rib 140 includes a top portion 140C and an inclined surface 140B that are respectively similar to the top portion 130C and the inclined surface 130B. The triangular rib 140 further includes a horizontal surface 140A (restriction part) and an inclined surface 140D (lower inclined part), wherein the horizontal surface 140A extends from the top portion 140C toward the side wall 100B, and the inclined surface 140D extends diagonally downward from an end of the horizontal surface 140A on the side wall 100B side. The horizontal surface 140A is a horizontal surface that extends from the top portion 140C to a certain position before reaching the side wall 100B. The inclined surface 140D is a plane extending straight diagonally downward from the end of the horizontal surface 140A on the side wall 100B side to the side wall 100B. With such a configuration of the triangular rib 140, in the process where the toner container 50 is attached to the attachment portion 40, after the memory holder 90 passes the top portion 140C of the triangular rib 140, the memory holder 90 is pushed back by the compression spring 99 toward the side wall 100B side. This allows the holder main body 91 to abut on the inclined surface 140D. At this time, the toner container 50 is guided to the attachment position of the attachment portion 40. In addition, the toner container 50 is restricted by the horizontal surface 140A so as not to be released easily.

Next, the lever 67 of the operation portion 54 is rotationally operated. With this operation, the toner discharge outlet 52 is opened. Specifically, the lever 67 is rotationally operated from the first operation position (see FIG. 10A) to the second operation position (see FIG. 10B). When the lever 67 is rotationally operated in the state where the toner container 50 is attached to the attachment portion 40, the operation driving force (driving force) is input to the first coupling portion 78 via the shaft 66 of the operation portion 54. This causes the shaft 66 and the first coupling portion 78 to be rotated clockwise integrally with the lever 67 (see FIG. 10B). That is, the first coupling portion 78 is rotated by the same angle as the lever 67.

The first coupling portion 78 is coupled with the first rotation portion 74 of the driving transmission mechanism 76, and thus is integrally rotated with the first rotation portion 74. As shown in FIG. 14, on the apparatus main body 28 side, the first gear 74A of the first rotation portion 74 meshes with the second gear 75A of the second rotation portion 75. As a result, the operation driving force is transmitted from the first rotation portion 74 to the second rotation portion 75, and the second rotation portion 75 is rotated in a certain direction (see FIG. 15).

The second rotation portion 75 is coupled with the second coupling portion 79 of the toner container 50, and thus is integrally rotated with the second coupling portion 79. As the second coupling portion 79 is rotated, the cylinder 61 is integrally rotated with the second coupling portion 79 to the opening position side.

To close the toner discharge outlet 52, the lever 67 of the operation portion 54 is rotationally operated from the second operation position (see FIG. 10B) to the first operation position (see FIG. 10A). With this rotational movement, the shaft 66 and the first coupling portion 78 are integrally rotated with the lever 67 in a certain direction (see FIG. 10A).

On the attachment portion 40 side, the operation driving force is transmitted from the first rotation portion 74 to the second rotation portion 75, and the second rotation portion 75 is rotated in a certain direction. The second rotation portion 75 is coupled with the second coupling portion 79 of the toner container 50, and thus is integrally rotated with the second coupling portion 79. As the second coupling portion 79 is rotated, the cylinder 61 is integrally rotated with the second coupling portion 79 to the closing position side. With this operation, the toner discharge outlet 52 is closed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner container comprising:

a container main body including a storing chamber in which toner is stored;

a cylindrical portion which extends outside from a side wall of the container main body and has an inner space that communicates with the storing chamber, and on whose circumferential surface, a toner discharge outlet is formed;

an opening/closing member provided in the inner space of the cylindrical portion and configured to, upon receiving a driving force, operate to open and close the toner discharge outlet; and a conveyance member which, rotatably provided in a region extending from the storing chamber to the inner space, includes a rotation shaft and a plurality of blades along the rotation shaft and is configured to, when being rotated, allow the plurality of blades to convey the toner that is present inside the storing chamber and the inner space toward the toner discharge outlet, wherein the plurality of blades include:

a first blade disposed in the storing chamber at a position near a boundary between the storing chamber and the inner space;

a second blade disposed in the inner space at a position more on the cylindrical portion side than the first blade; and a third blade disposed in the storing chamber to be further away from the cylindrical portion than the first blade, the first blade is larger in outer diameter than the third blade, and the second blade is larger than the first blade in inclination angle with respect to the rotation shaft of the conveyance member.

2. The toner container according to claim 1, wherein the cylindrical portion is provided on a lower part of the side wall of the container main body, on a bottom of the storing chamber, in a region corresponding to the first blade, a stepped portion is formed so as to expand a space of the storing chamber lower than the rotation shaft such that the first blade can be disposed, and the first blade is disposed between the stepped portion and the opening/closing member.

3. The toner container according to claim 2, wherein the stepped portion is formed to continue to an outer circumferential surface of the cylindrical portion.

4. The toner container according to claim 1, wherein a bottom of the storing chamber is formed in a shape of semicircular arc in correspondence with rotary orbit of the blades of the conveyance member.

5. The toner container according to claim 1, further comprising an operation portion provided on an upper part of the side wall of the container main body, the operation portion being used to operate the opening/closing member, wherein the opening/closing member includes an input portion which receives the driving force that is input when the operation portion is operated.

6. The toner container according to claim 1, wherein the opening/closing member is provided in the inner space and has a shape of a cylinder that is concentric with the cylindrical portion, and is configured to rotate around a cylindrical axis of the cylindrical portion so as to slidably contact an inner wall of the cylindrical portion, and upon receiving the driving force, rotate to open and close the toner discharge outlet.

7. An image forming apparatus comprising the toner container according to claim 1, and configured to form an image on a recording medium by using toner supplied from the toner container.

8. A toner container comprising:

a container main body including a storing chamber in which toner is stored;

a cylindrical portion which extends outside from a side wall of the container main body and has an inner space that communicates with the storing chamber, and on whose circumferential surface, a toner discharge outlet is formed;

an opening/closing member provided in the inner space of the cylindrical portion and configured to, upon receiving a driving force, operate to open and close the toner discharge outlet; and a conveyance member which, rotatably provided in a region extending from the storing chamber to the inner space, includes a rotation shaft and a plurality of blades along the rotation shaft and is configured to, when being rotated, allow the plurality of blades to convey the toner that is present inside the storing chamber and the inner space toward the toner discharge outlet, wherein the plurality of blades include a first blade and a second blade, the first blade being disposed in the storing chamber at a position near a boundary between the storing chamber and the inner space and being larger in outer diameter than the other blades, the second blade being disposed in the inner space and being larger than the first blade in inclination angle with respect to the rotation shaft of the conveyance member, and the opening/closing member includes:

a projection projecting from the boundary between the storing chamber and the inner space toward the storing chamber side; and a cut that is formed on an outer circumferential surface of the projection and is positioned at a top of the outer circumferential surface of the projection when the opening/closing member is at an opening position for opening the toner discharge outlet.

* * * * *